US007172357B2

(12) United States Patent
Gueret

(10) Patent No.: US 7,172,357 B2
(45) Date of Patent: Feb. 6, 2007

(54) APPLICATOR COMPRISING A SLOPING APPLICATOR ELEMENT AND A STEM CONNECTED VIA A HINGE TO A HANDLE MEMBER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 54 days.

(21) Appl. No.: 10/457,004

(22) Filed: Jun. 9, 2003

(65) Prior Publication Data

US 2004/0009028 A1 Jan. 15, 2004

Related U.S. Application Data

(60) Provisional application No. 60/388,317, filed on Jun. 14, 2002.

(30) Foreign Application Priority Data

Jun. 7, 2002 (FR) ..... 02 07059

(51) Int. Cl.
*A46B 11/00* (2006.01)

(52) U.S. Cl. ..... 401/129; 401/126; 401/122; 401/127; 15/185

(58) Field of Classification Search ..... 401/118–130; 15/171, 172, 185, 206, 207
See application file for complete search history.

(56) References Cited

U.S. PATENT DOCUMENTS

| | | | | |
|---|---|---|---|---|
| 2,173,959 A | | 9/1939 | Britt | |
| 3,185,291 A | | 5/1965 | Lerner | |
| 3,741,667 A | * | 6/1973 | Cesari | 401/175 |
| 4,165,755 A | | 8/1979 | Cassai | |
| 4,370,989 A | | 2/1983 | Taylor | |
| 4,396,028 A | | 8/1983 | Waggoner | |
| 4,428,388 A | | 1/1984 | Cassai et al. | |
| 4,898,193 A | | 2/1990 | Gueret | |
| 5,328,282 A | | 7/1994 | Charrier et al. | |
| 5,435,328 A | | 7/1995 | Grohoske | |
| 5,542,439 A | | 8/1996 | Gueret | |
| 5,758,382 A | * | 6/1998 | Maekawa et al. | 15/167.1 |
| 5,853,011 A | | 12/1998 | Gueret | |
| 5,860,432 A | * | 1/1999 | Gueret | 132/218 |
| 5,876,138 A | | 3/1999 | Gueret | |
| 5,891,906 A | | 4/1999 | Driedger et al. | |
| 5,894,847 A | | 4/1999 | Gueret | |
| 5,918,994 A | * | 7/1999 | Gueret | 401/122 |
| 5,934,292 A | | 8/1999 | Gueret | |
| 5,937,870 A | | 8/1999 | Gueret | |
| 6,026,823 A | | 2/2000 | Gueret | |
| 6,050,273 A | | 4/2000 | Lhuisset | |
| 6,220,254 B1 | | 4/2001 | Gueret | |

(Continued)

FOREIGN PATENT DOCUMENTS

EP 1 053 695 A2 11/2000

(Continued)

*Primary Examiner*—David J. Walczak
(74) *Attorney, Agent, or Firm*—Oliff & Berridge, PLC

(57) ABSTRACT

An applicator may include a handle member, a stem connected to the handle member via a hinge, and an applicator element at a first end of the stem. The stem and the applicator element may not extend entirely along a common rectilinear axis.

39 Claims, 16 Drawing Sheets

U.S. PATENT DOCUMENTS

| | | | | |
|---|---|---|---|---|
| 6,237,609 | B1 | 5/2001 | Vasas | |
| 6,532,967 | B1 * | 3/2003 | Dumler | 132/218 |
| 6,772,770 | B1 * | 8/2004 | Williams, Sr. | 132/309 |
| 2002/0020426 | A1 | 2/2002 | Gueret | |

FOREIGN PATENT DOCUMENTS

| | | |
|---|---|---|
| FR | 1395217 | 4/1964 |
| FR | 2701196 | 8/1994 |
| FR | 2 798 267 | 3/2001 |
| JP | 57-57510 | 4/1982 |
| JP | 58-86017 | 6/1983 |
| JP | 61-174515 | 10/1986 |
| JP | 1-153115 | 10/1989 |
| JP | 5-1411 | 1/1993 |
| JP | 2001-8727 | 1/2001 |
| JP | 2002-85150 | 3/2002 |
| WO | WO 93/16617 | 9/1993 |

* cited by examiner

APPLICATOR COMPRISING A SLOPING APPLICATOR ELEMENT AND A STEM CONNECTED VIA A HINGE TO A HANDLE MEMBER

CROSS REFERENCE TO RELATED APPLICATIONS

The present application claims the benefit of French patent application number 02-07059, filed Jun. 7, 2002 and U.S. Provisional patent application No. 60/388,317, filed Jun. 14, 2002, the disclosure of which is hereby incorporated by reference.

BACKGROUND OF THE INVENTION (i) Field of the Invention

The present invention relates to applicators of the kind comprising a handle member, a stem connected to the handle member via a hinge, and an applicator element disposed at one end of the stem.

(ii) Description of the Related Art

Such applicators, which are suitable for applying a cosmetic, are described in U.S. Pat. No. 6,026,823.

Other applicators are described in U.S. Pat. Nos. 5,328,282, US 2,173,959, US 4,396,028, US 5,435,328, FR 2,701,196, U.S. Pat. No. 4,165,755, FR 1,395,217, U.S. Pat. Nos. 4,428,388, US 3,185,291, and US 4,370,989.

Numerous brushes are known that are formed by twisting together two branches of a metal wire in a helix about tufts of bristles that project radially from the core, the branches being fixed in a stem made of a plastics material and secured in a cap for closing a receptacle that contains the makeup to be applied.

The free ends of the bristles define an envelope surface, which surface may be of a wide variety of shapes.

Thus, French patent application FR-A-2,605,505 discloses a brush having a rectilinear core and presenting a plurality of side faces each of which presents an indentation extending over substantially the entire length of the brush, each indentation presenting in cross-section a profile that is outwardly concave. Between them such indentations define ridge zones. The axis of the core coincides with the axis of the stem. When makeup is being applied by means of such a brush, the brush is turned about the axis of the stem and the eyelashes come into contact successively with side faces that are all identical in shape.

European patent application EP-A-0,663,161 describes a brush having a rectilinear core, and outwardly concave indentations in its side faces. The edges of the indentations belong to an envelope surface that is generally in the form of two truncated cones united via their bases.

European patent application EP-A-0,792,603 discloses a brush having a rectilinear core and a cylindrical portion in which one or more indentations are formed of width that passes through a maximum on going along the axis of the brush.

French patent application FR-A-2,755,593 discloses a brush presenting a core that is not rectilinear, extending in a plane of curvature. Over at least a fraction of its length, the envelope surface of the brush presents a cross-section of a shape that is elongate along a major axis parallel to the plane of curvature. The two halves of the envelope surface of the brush situated on either side of the plane of curvature are symmetrical thereabout.

French patent applications FR-A-2,749,489 and FR-A-2,749,490 disclose other curved-core brushes. The cross-sections defined by the bristles of those brushes vary homothetically from one end of the brush to the other. In other words, if two cross-sections of the brush taken at two different locations along the length thereof are compared, then one of the cross-sections is an enlargement of the other, i.e. they are geometrically similar, and the ratio of the dimensions from one section to the other is the same regardless of the direction about the axis of the core, i.e. there is no relative twisting between sections. Each of those brushes is made from a blank having an envelope surface that is symmetrical about a midplane perpendicular to the core.

U.S. Pat. No. 5,937,870 describes a brush in which the cross-section defined by the bristles is elongate in shape over at least a fraction of its length. That brush presents an envelope surface presenting two halves that are symmetrical about the plane of the curvature of the core.

U.S. Pat. No. 5,876,138 describes a generally fish-shaped brush with a rectilinear core.

German patent application DE-A-4,205,935 describes a curved-core brush of cross-section that is constant and circular.

French patent application FR-A-2,798,276 describes a device comprising a curved-core brush whose free end does not lie in alignment with the stem, thus making it easier to pick up makeup. The cross-section of the brush varies monotonically from the end of the brush connected to the stem going towards its free end.

SUMMARY AND OBJECTS OF THE INVENTION

The invention seeks to provide an applicator, in particular for the lips, the eyelids, the eyelashes, the eyebrows, or the hair, that is ergonomic in use, serving to further improve the application of makeup, in particular on the eyelashes.

When applying makeup to the eyelashes, there exists a need to further improve applicators that comprise a brush, in particular in terms of the amount of makeup carried by the brush, in terms of elongation, of curvature, of penetration of bristles between the eyelashes, and of the way in which the eyelashes are separated.

In one of its aspects, the invention provides an applicator comprising:

a handle member;

a stem connected to the handle member via a hinge; and an applicator element at a first end of the stem, the applicator being characterizable by the fact that the stem and the applicator element do not extend entirely along the same rectilinear axis.

By giving the stem a non-zero angle relative to the handle member, such an applicator makes applying makeup more ergonomic. In addition, since the applicator element includes at least one portion, e.g. a distal portion, that extends in a direction that forms a non-zero angle relative to the axis of the handle member, this angle can be increased by tilting the stem relative to the handle member without making it any more difficult to return the applicator into the receptacle even when the receptacle includes a wiper. The applicator element may be non-rectilinear, or the stem and the applicator element need not extend entirely along the same rectilinear axis. In which case, for example, the applicator element and the stem may extend in a plane, and the stem may be capable of pivoting only in said plane. The longitudinal axis of the applicator element may also extend outside the pivot plane of the stem.

The stem may include a sealing member configured to press in substantially leaktight manner against a surface of a receptacle on which the applicator is fitted when not in use. By way of example, the sealing member may comprise a disk and/or a frustoconical portion.

Applicator Elements Comprising a Brush

In an aspect of the invention, the applicator element may be configured to apply a makeup to keratinous fibers and may comprise a brush having bristles that extend transversely to the longitudinal axis of the brush.

Such a brush has a core with a portion from which the bristles extend, which may be referred to as the "bristle-carrying" portion.

In an embodiment, the core may be curved, at least over a fraction of its length.

A "curved core" should be understood as a "non-rectilinear core", in other words in the meaning of the present invention, a discontinuous line can constitute a "curved line".

The envelope surface defined by the bristles of the brush can be nonsymmetrical relative to a midplane perpendicular to the core.

The angle between the axis of the portion of the stem adjacent to the brush and the axis of the core, may be less than 90° at all points therealong.

The brush may present a free end that is not in alignment with the axis of the portion of the stem that is adjacent to the brush.

The cross-section defined by the bristles of the brush may vary in non-monotonic manner from one end of the brush to the other.

When the cross-section is said to vary in "non-monotonic" manner, it should be understood that the cross-section of the brush is not constant over the entire length of the brush and does not vary in strictly increasing or decreasing manner from one end of the brush to the other. The fact that the cross-section defined by the bristles varies in non-monotonic manner may be due, for example, to the shape of the blank from which the brush is made, said blank possibly presenting an extreme diameter at a non-zero distance from each end of the brush, or possibly having one or more indentations, etc.

In a particular embodiment, the brush is made from a blank having a rectilinear core, the bristle-carrying portion having an envelope surface that is not symmetrical relative to a midplane perpendicular to the core, the blank having an edge that is not rectilinear when observed in profile in a direction perpendicular to the core, said edge being straightened out, at least in part, by the curvature imparted to the core of the blank during fabrication of the brush.

Such a brush can ensure that very satisfactory quality of makeup is obtained because the core is curved and, when observed from the side in a direction perpendicular to the axis of the stem, presents a profile which varies on the brush being rotated about the axis of the stem.

In particular, the brush may make it possible to take charge of the eyelashes effectively and may also make it possible to obtain wiping that is not uniform, leading to zones of the brush that are loaded with makeup in non-uniform manner.

Thus, the user can cause the brush to carry a larger quantity of makeup making it possible to add more makeup to the eyelashes locally, should that turn out to be necessary while applying makeup, without it being necessary to dip the brush back in the receptacle, and also to have bristles that carry little makeup which can advantageously be used for separating the eyelashes, and in particular the short eyelashes at the ends of the eyelids.

Starting from a brush as defined above, it is possible for observation purposes to return to the blank used for fabricating it by straightening out its core completely, i.e. by making it completely rectilinear.

The curvature of the core need not be constant.

The fact that its curvature is not constant along the length of the brush means that its radius of curvature (which may be infinite) is not the same at at least two different points along the brush. The brush may thus be more curved adjacent to its free end than adjacent to the stem, for example, or it may include a portion that is rectilinear or substantially rectilinear, together with a portion that is curved, as applies in particular when the core of the brush presents a rectilinear portion engaged in the stem and the bristles are supported by a curvilinear bristle-carrying portion, which portion may present curvature that is constant or otherwise.

In a particular embodiment, the cross-section of the brush may pass through at least one extremum between its two axial ends. This extremum may be a maximum or a minimum, and, in particular, between its two axial ends the cross-section of the brush may pass both through a maximum and through a minimum, as applies in particular when the blank from which the brush is made presents the general shape of a fish.

In a particular embodiment, the blank may present an envelope surface that is circularly symmetrical.

The blank used for making the brush may also present an envelope surface that is not circularly symmetrical, but merely axially symmetrical relative to the axis of the core, for example.

The cross-section of the envelope surface of the blank may present a shape that varies, over at least a fraction of the length of the brush, for example over more than one-third of its length, in homothetic manner. In other words, if two cross-sections of the brush taken at two different points along the length of the brush are compared, one of the sections is an enlargement of the other, i.e. they are geometrically similar, and furthermore the ratio of the dimensions of one section to another remains constant regardless of the direction about the axis of the core, i.e. there is no relative twisting between sections.

In order to make the brush, the core and the blank may be curved about at least one axis lying outside the midplane of the blank. One edge of the blank which is straightened out by the curvature imparted to the core may be situated in the distal portion or in the proximal portion of the brush, i.e. in the first or the second half of the length of the brush starting from its free end. The above-mentioned non-rectilinear edge of the blank may be situated substantially in the first or the last third of the brush starting from its free end. This non-rectilinear edge may be outwardly concave, or in a variant outwardly convex. By way of example, when the non-rectilinear edge is outwardly concave, it may be situated substantially in the last third of the brush. This applies in particular when the blank is generally fish-shaped. When the non-rectilinear edge is outwardly convex, it may be situated, by way of example, in the first third of the brush. This may apply in particular when the blank is generally bullet-shaped or buoy-shaped.

In a particular embodiment, the non-rectilinear edge of the blank is defined at least in part by a distal end portion of the brush that is bullet-shaped, the body of the brush presenting the shape of a truncated cone with a cross-section that decreases from said distal end portion over at least a fraction of the length of the brush going towards the stem to which the core is connected.

In another particular embodiment, the non-rectilinear edge of the blank is defined by the zone surrounding the junction between a distal end portion of the brush in the form of a truncated cone converging towards the free end of the brush, and the body of the brush which is likewise in the form of a truncated cone converging towards the stem to which the core is connected.

In another particular embodiment, the blank is generally fish-shaped, the non-rectilinear edge of the blank being defined by the zone in the vicinity of the junction between the body of the fish and the proximal end portion constituting the tail of the fish.

In another particular embodiment, the brush is made from a blank that is hourglass-shaped, the non-rectilinear edge of the blank being defined by the reentrant angle at the junction between the two truncated cones.

In another particular embodiment, the blank is in the form of a (rugby or American) football including at least one facet or indentation, the non-rectilinear edge being defined by the indentation or being situated in the vicinity of one end of the indentation or of the facet.

The non-rectilinear edge of the blank may advantageously be deformed by the curvature imparted to the core so as to be situated at least in part substantially on the axis of the adjacent edge of the body of the brush when the brush is seen in a direction perpendicular to the axis of the stem.

The core may be a twisted core, of left-hand or right-hand twist, and in particular of left-hand twist as described in French patent application FR-A-2,701,198. In a left-hand twist brush, the branches of the core are twisted together by turning to the left to form the turns which, when seen along the axis of the core from the end fixed in the stem, turn clockwise on going from the stem towards the free end of the brush.

The core is advantageously curved when the brush has a left-hand twist so as to decrease the angle of inclination between the helical sheets formed by the bristles and the axis of the stem on going away from the stem, thus making it possible to improve separation between the eyelashes at the ends of an eyelid, by increasing the angle between the eyelashes and said sheets.

It is also possible to act on the curvature imparted to the core, when said core has a right-hand twist so as to cause the bristles to point in a desired direction.

The core need not be made by twisting together two branches of a metal wire, for example the bristles may be implanted in or molded with other supports.

The bristles may be natural or synthetic, and their ends may be subjected to any known type of treatment, e.g. for the purpose of forming tips that are rounded or fork-shaped.

The brush may have bristles of different lengths, and in particular short bristles contained within the volume defined by the envelope surface of the free ends of long bristles.

The brush may comprise a mixture of bristles.

The bristles used may be of any kind, in particular hollow bristles, bristles having a capillary groove, bristles that are flat or twisted, or indeed bristles having a preferred deformation zone.

It is also possible to use a brush of arbitrary shape having a core which is curved about more than one axis. In particular, the core may be curved about two axes that are not mutually parallel. Under such circumstances, the axis of the core is not fully contained in a single plane of curvature. The axes about which the core is curved may extend in directions that are optionally perpendicular, and they may optionally intersect.

The stem of the applicator may be provided with a brush made using a method comprising the following steps:

making a blank having a rectilinear core, in particular having a cross-section that varies in non-monotonic manner from a first end of the brush to a second end, the blank having an envelope surface that is not symmetrical about a midplane perpendicular to the core; and curving the core in such a manner that the first end of the brush is not in alignment with the axis of the rectilinear portion of the core adjacent to the second end, with the angle formed between the axis of the rectilinear portion of the core and the axis at any point along the curved portion of the core remaining less than 90°.

In a particular implementation, the method comprises the following steps:

making a blank with a rectilinear core of non-constant cross-section, and, over at least a fraction of the length of the blank, with an edge that is not rectilinear when the blank is observed in profile in a direction perpendicular to the core; and curving the core in such a manner as to reduce the curvature of said non-rectilinear edge of the blank when the brush is observed in the same direction as before.

The blank may be optionally circularly symmetrical, and may present, for example, the general shape of a bullet, a buoy, a fish, an hourglass, or a (rugby or American) football.

At least one facet or indentation may be formed in the blank prior to curving the core. At least three such facets or indentations may be formed so as to give the brush a cross-section over at least a fraction of its length that is generally triangular in shape.

By way of example, maximum curvature may be given to the core in the swollen portion of the blank when the blank is generally bullet- or buoy-shaped so as to raise the distal end portion of the blank, thereby having the effects of straightening out the non-rectilinear top edge of the swollen portion of the blank and of accentuating the curvature of its diametrically-opposite bottom edge.

By way of example, it is also possible to give maximum curvature to the core in the vicinity of the narrowest portion of the blank when the blank is in the general shape of a fish or an hourglass, so as to raise the proximal end portion of the blank with the effects of further deepening the upwardly concave top edge of the blank and of flattening its downwardly-concave diametrically-opposite bottom edge.

In general, the curvature imparted to the core may have the effect of pushing away a concave- or convex-shaped face of the brush so as to make it substantially rectilinear, for example, and in particular substantially parallel to the axis of the stem.

When the curvature imparted to the core has the effect of straightening out a convex or concave face in order to make it substantially rectilinear, the curving may be performed about an axis contained in a midplane of said face.

The blank may have a left-hand twist.

The stem of the applicator may be provided with a brush of arbitrary shape and having a bristle-carrying portion presenting a free end which is not in alignment with the longitudinal axis of the end of the stem that is adjacent to the brush, and that is not in alignment with the longitudinal axis of the handle member in the event of the angle of inclination of the stem relative to the handle member being zero.

The core of the bristle-carrying portion may be curved in such a manner that a line tangential to the core at any point along the core is not perpendicular to the longitudinal axis of the end of the stem adjacent to the brush.

In another aspect of the invention, the bristles of the bristle-carrying portion may have ends that define an envelope surface having a cross-section which varies over at least a fraction of the length of the brush, the envelope surface being non-symmetrical relative to the midplane of the envelope surface perpendicular to the core. Where appropriate, the core may be curved about two axes that are not mutually parallel, as mentioned above.

Such a brush makes it possible to cause the bristles of the brush to be loaded in non-uniform manner, since at least some portions of the brush are offset from the axis of the stem and thus from the axis of the wiper.

The axes about which the core is curved may extend in directions that are perpendicular, and they may optionally intersect. They may lie in planes of symmetry for certain portions of the brush.

The brush may be made by curving the core of a blank whose envelope surface is circularly symmetrical over at least a fraction of its length, in such a manner as to change the shape of said envelope surface in said fraction.

The brush may also be made from a blank having one or more indentations and/or facets cut therein, which facets may be substantially plane, being parallel to the rectilinear core of the blank, or at an angle relative to thereto.

Another type of brush which may advantageously be used with a stem of variable inclination may include a curved core with bristles connected thereto, the brush presenting a cross-section which varies over at least a fraction of the length of the brush in non-homothetic manner, said section at at least one point of the core being non-symmetrical relative to a plane perpendicular to the plane of curvature of the core at that point.

The brush may present at least three side faces of shapes that differ from one another.

The brush may present at least two plane side faces.

When the applicator element is a brush, it may be made from a blank that is in the general shape of a bullet, a peanut, a buoy, a fish, an hourglass, or a American football.

By way of example, it is possible to use a brush connected to one end of the stem, said end of the stem having a longitudinal axis, the free end of the brush not being in alignment with the longitudinal axis of the stem. At least one portion of the core is curved in such a manner that a tangent to the core at any point of the core is not perpendicular to the longitudinal axis of the end portion of the stem. The brush carries bristles, and the ends of the bristles may define an envelope surface having a cross-section that varies along at least a fraction of the length of the core, said envelope surface being non-symmetrical about a midplane, the midplane extending perpendicularly to the core.

The brush may include a core that is curved over at least a fraction of its length in such a manner that an axis of the core defines a curve in a plane of curvature, and a plurality of bristles defining a cross-section for the brush which varies over at least a fraction of the length of the core in a manner that is not geometrically symmetrical. The cross-section of the brush at at least one point along the core may be substantially nonsymmetrical relative to a plane perpendicular to the plane of curvature, and the core may pass through the center of the cross-section of the brush in at at least one point along its length.

In a variant, the brush may have a core that is curved over at least a fraction of its length in such a manner that the axis of the core defines a curve in a plane of curvature, the curve having a convex side and a concave side. The bristles define a cross-section for the brush which varies over at least a fraction of the length of the core in a manner that is not homothetic, the cross-section of the brush at at least one position along the core being substantially non-symmetrical about a plane perpendicular to the plane of curvature. In the plane of curvature, the distance from the convex side of the curve to the envelope surface may vary along at least a fraction of the length of the core.

The brush may have a core that is curved over at least a fraction of its length in such a manner that an axis of the core defines a curve in a plane of curvature, and a plurality of bristles extend from the core so as to define a cross-section for the brush which varies over at least a fraction of the length of the core in a manner that is not homothetic. The cross-section of the brush at at least one position along the core may be substantially non-symmetrical relative to a plane perpendicular to the plane of curvature, and when the core is straight, the ends of the bristles define at least one indentation having a maximum width situated between the ends of the indentation, said ends being spaced apart from each other along the length of the brush.

The brush may also comprise a core that is curved over at least a fraction of its length in such a manner that an axis of the core defines a curve in a plane of curvature, and a plurality of bristles extending from the core, the bristles defining a cross-section for the brush which varies over at least a fraction of the length of the core in a manner that is not homothetic. The cross-section of the brush at at least one position along the core may be substantially non-symmetrical about a plane perpendicular to the plane of curvature, and when the core is straight, the ends of the bristles define at least one indentation, said indentation being concave in at least one plane intersecting the indentation.

The brush may also comprise a core that is curved along at least a portion of its length in such a manner that an axis of the core defines a curve in a plane of curvature, the curve having a convex side and a concave side. A plurality of bristles extend from the core, the bristles having ends that define an envelope surface of the brush. The bristles also define a cross-section for the brush which varies over at least a fraction of the length of the core in a manner that is not homothetic. The cross-section of the brush at at least one position along the core may be substantially non-symmetrical about a plane perpendicular to the plane of curvature, and the envelope surface on the convex side of the curve may define a surface that is substantially plane along at least one portion of the length of the brush, said substantially plane surface intersecting the plane of curvature.

The brush may also comprise a core that is curved along at least one portion of its length in such a manner that an axis of the core defines a curve in a plane of curvature, the curve having a convex side and a concave side. A plurality of bristles are connected to the core, the bristles having ends that define an envelope surface of the brush. The bristles define a cross-section for the brush which varies over at least a fraction of the length of the core in a manner that is not homothetic. The cross-section of the brush at at least one position along the core is substantially non-symmetrical about a plane perpendicular to the plane of curvature. In the plane of curvature, the envelope surface of the convex side of the curve may define a portion that is substantially rectilinear along at least a fraction of the length of the brush.

The brush may also comprise a core that is curved along at least a fraction of its length in such a manner that an axis of the core defines the curve in a plane of curvature. A plurality of bristles are connected to the core. The bristles define a cross-section of the brush which varies over at least a fraction of the length of the core in a manner that is not homothetic. The cross-section of the brush at at least one position along the core may be substantially non-symmetrical about a plane perpendicular to the plane of curvature. The stem has one end connected to the core, said end defining an axis, and the free end of the brush may be out of alignment with the axis of the end of the stem.

The brush may also comprise a core that is curved over at least a fraction of its length in such a manner that an axis of the core defines a curve in a plane of curvature. A plurality of bristles extend from the core, the bristles defining a cross-section for the brush which varies over at least a fraction of the length of the core in a manner that is not homothetic. The cross-section of the brush at at least one position along the core may be substantially non-symmetrical about a plane perpendicular to the plane of curvature and over at least a fraction of the length of the brush the cross-section of the brush may be of varying width, the width passing through the core being perpendicular to the plane of curvature.

Applicator with a Maneuverable Portion

In an embodiment of the invention, the applicator may include a maneuverable portion for modifying the direction in which the stem points relative to the handle member, said maneuverable portion extending at least in part between the hinge and a second end of the stem, opposite from its first end.

Such a maneuverable portion may make it possible in use to modify the direction in which the applicator element points relative to the handle member.

The maneuverable portion, the hinge, and the handle member may be configured in such a manner as to enable the user to modify the direction in which the stem points using one hand by acting with a finger on the maneuverable portion while the applicator is not in place on a receptacle.

The handle member may comprise a body with the maneuverable portion going through one end of the body. At said end, the body may have an end wall provided with an opening through which the maneuverable portion passes. This end portion may be generally outwardly convex in shape.

The above-mentioned opening may comprise at least one slot, which slot can serve to guide the movement of the maneuverable portion. Where appropriate, the slot may be extended over at least a fraction of the side surface of the handle member. By way of example, the opening may comprise at least two slots with the longitudinal axes of these slots being substantially perpendicular to each other, for example. The slot(s) may include edges defining at least one hard point for displacement of the maneuverable portion, for example by means of at least one projection. Where appropriate, the hard point can make it easier to hold the maneuverable portion in a predetermined position.

The applicator, for example its end wall, may include at least one reference mark, for example graduations, making it easier for the user to identify the direction in which the stem is pointing relative to the handle.

The maneuverable portion may include a cover configured to cover the handle member at least in part. By way of example, the cover may present a face that is generally concave towards the handle member.

The maneuverable portion may be covered at least in part by a sheath, e.g. a sheath having at least one flexible region. The flexible region may comprise a bellows, in particular.

The maneuverable portion may be completely covered by the sheath.

The sheath may be entirely flexible, for example being made out of an elastomer such as butyl nitrile, ethylene-propylene diene monomer (EPDM), silicone, or latex, for example, this list not being limiting.

The sheath may be fitted to the handle member or, in a variant, it may be formed integrally by being molded with the handle member, e.g. by being injection-molded thereover.

The outside shape of the sheath may be axially symmetrical, e.g. presenting a cross-section that is circular over at least a fraction of its length.

The sheath may have an outside shape that facilitates deformation thereof in one or more directions. Thus, for example, the sheath may present a cross-section that is oblong over at least a fraction of its length.

The sheath may have a wall of greater or lesser thickness. By way of example, the sheath may have a wall whose thickness, at least in some places, is of the same order of magnitude as the thickness of a wall of the handle member.

The sheath may also have a wall that is relatively thick, in particular when it is made out of a cellular material.

By way of example, the sheath may comprise a block of foam provided with a recess or with at least one slot in which the second end of the stem is engaged. Such a block may be fixed to one end of the body of the handle member, for example by heat-sealing or by adhesive.

The sheath may contribute to sealing the closure of a receptacle on which the applicator is fitted when not in use.

The Hinge

The hinge may be disposed inside the handle member.

The fact of placing the hinge inside the handle member may make the applicator more compact and easier to hold in the hand.

The hinge may be configured to prevent significant lateral and/or axial displacement of the stem relative to the handle member.

The absence of axial displacement at the hinge, i.e. displacement in the direction of the longitudinal axis of the handle member, and/or the absence of lateral displacement, i.e. displacement perpendicularly to the longitudinal axis of the handle member, said displacement being displacement of the stem relative to the handle member, can enable the user to position the applicator element precisely at the location where the makeup is to be applied.

The hinge may include a brake to brake the movement of the stem relative to the handle member. The brake may exercise braking action regardless of the position of the stem relative to the handle member. In a variant, the brake may exert braking action only in at least one predetermined position of the stem relative to the handle member.

The hinge may be made in various ways, for example it may enable the stem to move about one axis, two axes, or an infinity of axes.

By way of example, the hinge may comprise a ball-and-socket joint, which may have a seat that is rigid or flexible. A rigid seat makes it possible, where appropriate, to obtain better sealing of the closure of the receptacle, e.g. by providing better contact between the receptacle and a sealing member of the stem.

In a variant, the hinge may have a pin, for example a metal pin with the stem being mounted to pivot thereon. Alternatively, the stem may have a cylindrical portion that acts as a pivot.

The hinge may have at least one flexible wall, for example a disk, through which the stem passes, said wall extending between the stem and the handle member. In an embodiment, the hinge has at least one block of elastically deformable material, e.g. a foam, through which the stem passes.

The applicator may be configured in such a manner that the stem continues to point in the direction imparted thereto by the user after the user has released the maneuverable portion.

The applicator may alternatively include a resilient return member suitable for returning the stem to point in a predetermined direction when the user releases it, e.g. in order to bring its axis into alignment with the axis of the handle member. The return member may be constituted, for example, by an element constituting the hinge. The return member may be constituted by a sheath as described above.

Other Applicator Elements

The applicator element may comprise a comb configured to apply a makeup on keratinous fibers, for example on the eyelashes or the eyebrows.

The applicator element may comprise a brush made by injection-molding a plastics material, the brush including serrations.

In a variant embodiment, the applicator element may be in the form of paintbrush, in particular a brush for applying nail varnish. Under such circumstances, the stem may include a bend, for example.

The applicator element may also comprise a foam, a sponge, a felt, or a flocked endpiece, being configured for example to apply a makeup to the lips or to the eyelids.

The applicator element may be suitable for retaining the makeup by capillarity.

The applicator element may present an axis that is rectilinear or curved.

The applicator element may be flocked.

Packaging and Applicator Device

The invention also provides a packaging and applicator device for a cosmetic, the device comprising a receptacle containing the cosmetic and an applicator as defined above.

The applicator may be configured to close the receptacle.

The receptacle may include a wiper. The wiper may enable the stem to be returned to a position of zero inclination when the applicator is returned to the receptacle.

The receptacle and the applicator may be configured in such a manner that the stem of the applicator is prevented from pivoting relative to the receptacle when the applicator is in place thereon.

Sealed closure of the receptacle may be obtained by sealing means situated relative to the hinge and along the axis of the stem either above the hinge, around the hinge, or below the hinge.

Method of Application

The invention also provides a method of applying a cosmetic on a part of the body or the face, in particular on the eyelashes or the eyebrows, the method comprising the following steps:

loading an applicator element of any kind with the cosmetic, the applicator element being present at one end of a stem connected in hinged manner to a handle member having an axis; and modifying the direction in which the stem points relative to the handle member.

When the applicator element is configured to apply makeup on keratinous fibers, for example the eyelashes and/or the eyebrows, the method may comprise the following steps:

applying makeup to the keratinous fibers, e.g. with the stem substantially horizontal and at a first inclination of the stem relative to the handle member, this first inclination being zero, for example, the stem being capable of being turned about its own axis and the applicator element being constituted by one of the brushes as defined above, and applying makeup to the keratinous fibers with the stem substantially vertical and at a second inclination of the stem relative to the handle member, the second inclination being different from the first, e.g. the stem being at a maximum inclination relative to the handle member. When the applicator element is constituted by one of the brushes as defined above, makeup can be applied without turning the stem about its own axis.

BRIEF DESCRIPTION OF THE DRAWINGS

The invention can be better understood on reading the following detailed description of non-limiting embodiments and on examining the accompanying drawings, in which.

DETAILED DESCRIPTION OF PREFERRED EMBODIMENTS

Figure 1:
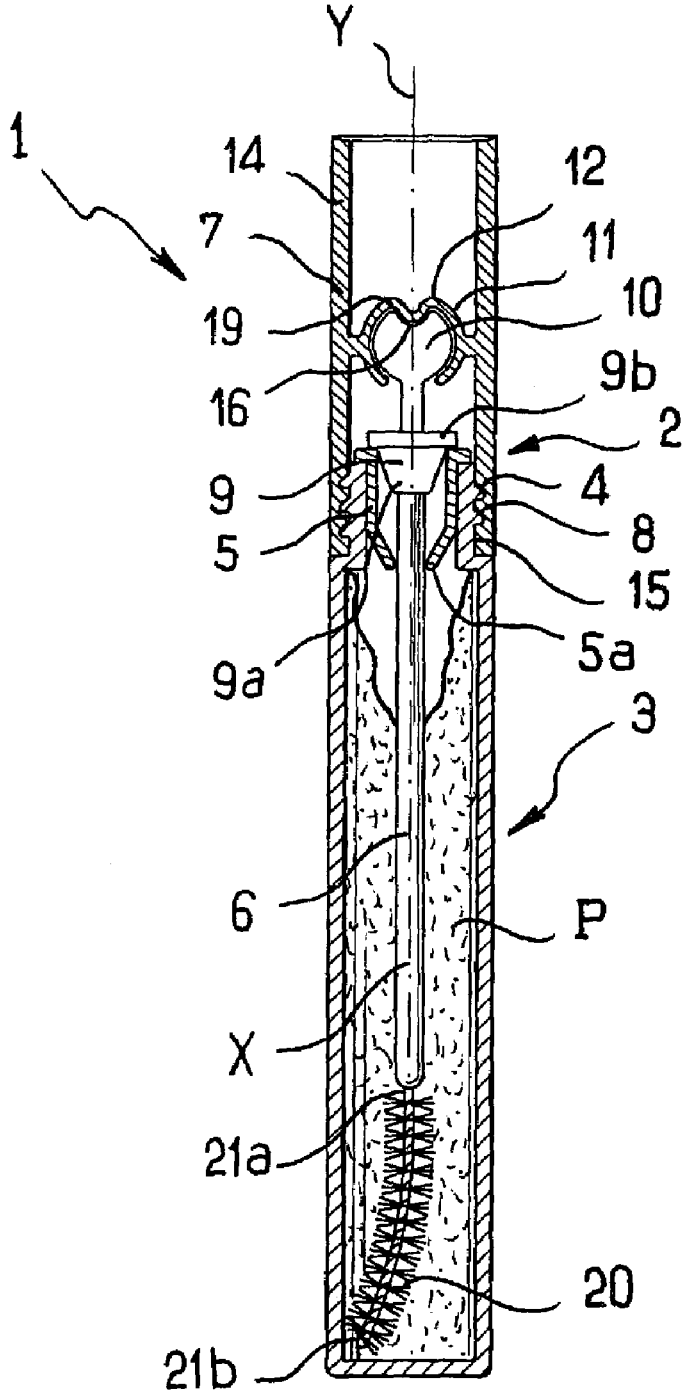
FIG. 1 is a diagrammatic axial section view of a device for applying a makeup to the eyelashes or the eyebrows and made in accordance with the invention.
Figure 2:
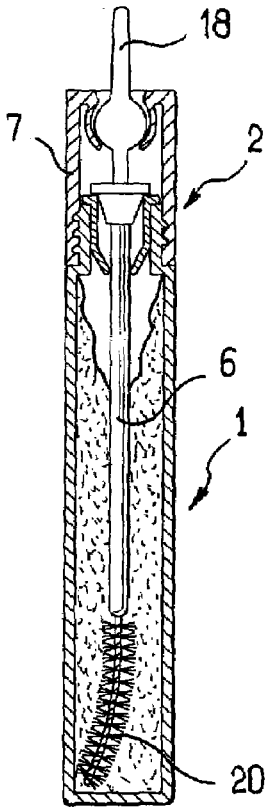
FIG. 2 shows a variant embodiment in which the applicator is provided with a maneuverable portion.

The device 1 shown in FIG. 1 is for applying makeup P to the eyelashes or the eyebrows, e.g. mascara, and comprises an applicator 2 and a receptacle 3 containing the makeup P, onto which receptacle the applicator 2 can be fixed in substantially leaktight manner while not in use. In conventional manner, the receptacle 3 may have a threaded neck 4 with a wiper 5 fixed therein, e.g. a wiper made of elastomer and optionally including a flexible lip of generally conical shape.

In the example shown, the applicator 2 comprises a stem 6 that is rectilinear along an axis X and a handle member 7 of axis Y, which handle member also constitutes a closure cap for the receptacle 3, being provided for this purpose with an inside thread 8 shaped to screw onto the neck 4.

The stem 6 includes a sealing member 9 configured to co-operate with the opening in the receptacle 3 when the applicator 2 is in place thereon, as can be seen in FIG. 1. By way of example, this sealing member 9 may comprise a frustoconical portion 9*a* provided at its top end with a collar 9*b* shaped to bear against the top edge of the wiper 5. Inside the receptacle, the wiper defines a wiping orifice 5*a* which may be circular when the portion of the stem to be wiped is circular in section, and matching the diameter thereof. By way of example, in a variant, the wiper member may comprise only the frustoconical portion or only a disk, and it may include a sealing skirt, for example. In particular when the wiper member comprises a disk, it may include an elastomer cord.

The handle member 7 comprises a generally tubular body 14, e.g. made of a rigid plastics material, presenting an outside shape that is circularly symmetrical about the axis Y in the example shown, the body 14 defining an opening 15 at one of its axial ends so as to enable it to be engaged on the neck 4 of the receptacle 3.

The stem 6 is connected in hinged manner to the handle member 7.

By way of example, the applicator 2 may have a hinge in the form of a ball-and-socket joint, comprising a generally spherical portion 10 formed on the stem 6 and a socket or seat 11 of complementary shape inside the handle member 7. Such a ball-and-socket joint may optionally allow the stem 6 to be turned about its own axis X relative to the handle member 7, while preventing significant axial and/or lateral movement of the stem 6 in the hinge relative to the handle member 7.

In the example shown in FIG. 1, the spherical portion 10 has a setback 16 for co-operating with a corresponding projection 19 formed on a wall 12 of the handle member that defines the socket 11. This projection 19 lies on the axis Y.

Engagement of the projection 19 in the setback 16 can contribute to holding the stem 6 on the axis of the handle member 7. It can also provide the user with an audible or tactile sensation giving information about the position of the stem relative to the handle member.

At one end, the stem is provided with an applicator element 20 which is constituted by a mascara brush, for example.

The applicator element may optionally come into contact with the bottom of the receptacle when the applicator is in place.

In the example shown in FIGS. 2 to 5, the socket 11 is defined by a wall 12 of the applicator member which does not include the projection 19 and which is connected at a top end to an inwardly-directed rim 13 of the body 14.

The stem 6 is provided with a maneuverable portion 18 for pointing the stem relative to the handle member 7.

The angle ii formed between the axis X of the stem 6 and the axis Y of the handle member 7 an be changed by the user.

Changing the direction in which the stem 6 is pointing relative to the handle member 7 when the applicator includes a maneuverable portion 18 can be done without touching the portion of the stem that is inserted into the receptacle when the applicator is in place thereon, and thus without any risk of the user dirtying the fingers.

Furthermore, the maneuverable portion 18 of the stem 6 can enable the user to visualize a change in the direction of the applicator element relative to the handle while making up.

In the example of FIGS. 1 to 5, the brush 20 has a curved core, the proximal portion 21*a* of the core 21 adjacent to the stem being connected thereto substantially on the axis X of the stem 6, and with the distal portion 21*b* of the core 21 pointing in a direction Z that forms an angle i with the axis X.

Figure 4:
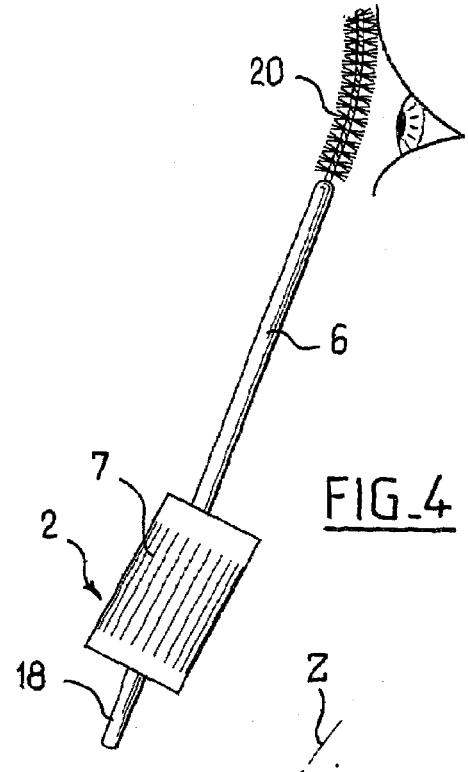
FIG. 4 shows the FIG. 3 applicator being used to make up the eyelashes, with the stem pointing substantially vertically.
Figure 3:
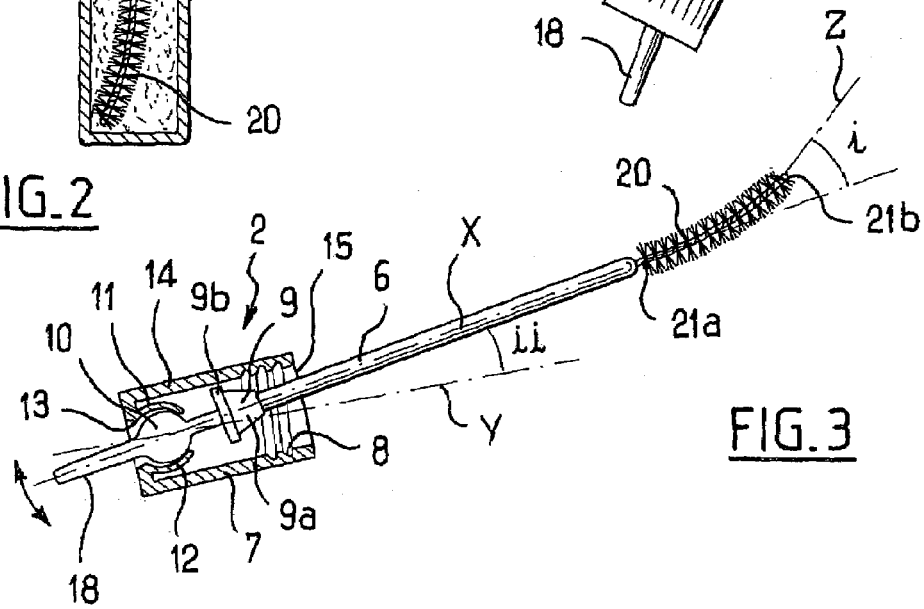
FIG. 3 shows the applicator of the FIG. 2 device in isolation, after the stem has been pivoted relative to the handle.

The angle formed between the direction Z and the axis Y of the handle member 7 may correspond to the sum of the angles i and ii, thus making it possible, for example, to apply the makeup to the eyelashes while the applicator stem is pointing upwards, as shown in FIG. 4. In this figure, the applicator is shown as having a maneuverable portion 18, but the explanation is equally applicable when the applicator does not include one.

While making up with the applicator stem pointing upwards, the angle formed between the stem and the handle member can be relatively large, so as to be able to hold the handle member away from the face and so as to make it easier to apply makeup.

Figure 5:
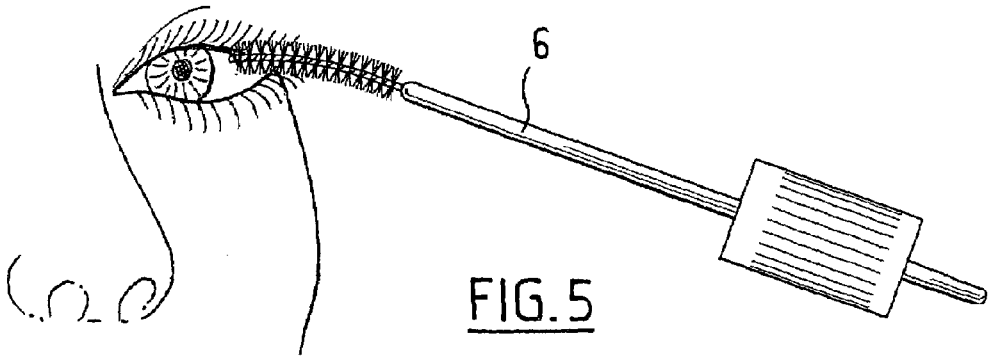
FIG. 5 shows the FIG. 3 applicator in use for making up the eyelashes, with the stem pointing substantially horizontally.

When the applicator is used with its stem substantially horizontal, the stem can point at a substantially zero angle relative to the axis of the handle member, as shown in FIG. 5. The brush can be turned about the axis X of the stem, for example.

The applicator may be configured in such a manner that the stem conserves the direction in which it has been pointed, e.g. by means of the maneuverable portion 18, even after the stem has been let go.

In a variant, and when the stem includes a maneuverable portion 18, the applicator may be configured in such a manner as to return the stem to a predetermined direction relative to the axis of the handle member, once the maneuverable portion 18 has been released.

When the applicator is in place on the receptacle, co-operation between the stem (and where appropriate the sealing member 9) with the receptacle, e.g. with the wiper member 5, can have the effect of preventing significant pivoting of the maneuverable portion 18 relative to the handle member, contrary to that which occurs, for example, with the device described in French patent No. FR 1,395, 217.

In one amongst other aspects of the invention, the applicator may include a curved-core brush such as one of the brushes shown in FIGS. 10 to 13.

Figure 10:
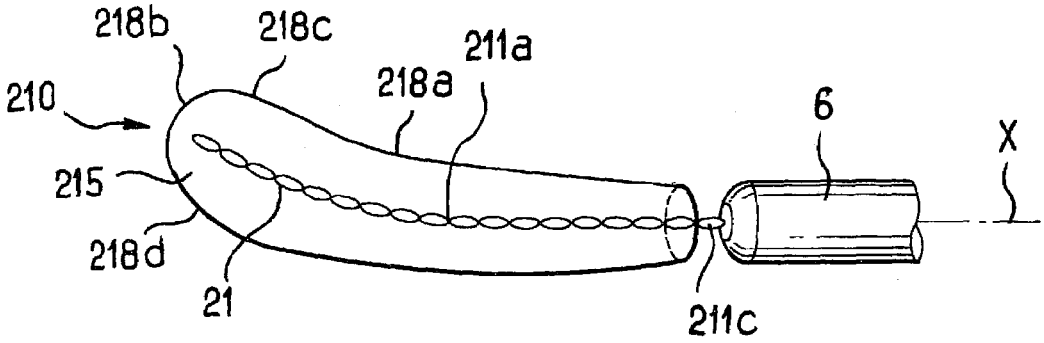
FIGS. 10 to 13 show the brushes obtained respectively from the blanks shown in FIGS. 6 to 9.

FIG. 10 shows a brush 210. The core 21 of the brush 210 is made by twisting together two lengths of metal wire. Bristles (not shown) are held between the turns of the core in conventional manner.

In order to clarify the figure, FIG. 10 shows only the envelope surface as defined by the free ends of the long bristles.

The core 21 is fixed to one end of the stem 6 of axis X. The stem is made of plastics material, for example, and the core 21 is forced into a socket situated at the end thereof.

Figure 6:
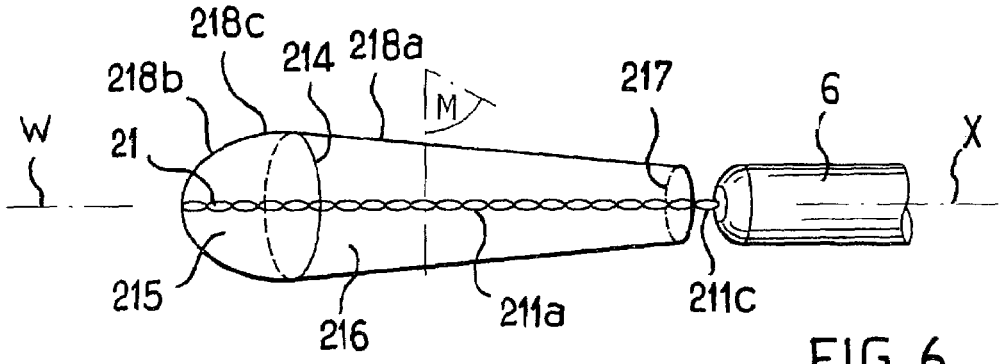
FIGS. 6 to 9 show various examples of blanks from which brushes can be made in one aspect of the invention.

In order to make the brush 210, the starting shape is a blank as shown in FIG. 6 having an envelope surface that is generally bullet-shaped. This envelope surface is circularly symmetrical about the rectilinear axis W of the core 21, while not being symmetrical about a midplane M intersecting the core 21 halfway from the bristle-carrying portion of the blank.

The enlarged portion of the brush has a maximum diameter at a maximum diameter circle 214.

The distal end portion 215 of the brush is bullet-shaped and the body 216 of the brush is in the form of a truncated cone, the diameter of the body 216 tapering towards the stem 6 down to a minimum at an end circle 217.

The top edge of the blank shown in FIG. 6 comprises a rectilinear first portion 218*a* extending along the body 216 between the circles 214 and 217, and a rounded, second portion 218*b* defining the top of the distal end portion 215, which rounded portion is in the form of one-fourth of an ellipse in the example shown.

The regions of the portions 218*a* and 218*b* surrounding the circle 214 constitute a non-rectilinear edge 218*c*.

In order to make the brush 210, the core 21 is subjected to twisting about an axis perpendicular to the plane of FIG. 6 so as to straighten out the distal end portion 215 of the blank, thereby causing the edge 218*c* to become plane, which edge becomes substantially rectilinear and in line with the portion 218*a*, as can be seen in FIG. 10.

It should be observed that the brush 210 is not circularly symmetrical about the axis X of the stem 6. The ends of the bristles of the brush 210 situated beside the edge 218*c* are displaced further from the axis X of the stem 6 than the ends of the diametrically opposite bristles. Thus, after the brush 210 has been withdrawn from the receptacle through the wiper, a larger quantity of makeup is obtained on the edge 218*d* that lies substantially on the axis X of the stem 6, while the edge 218*c* is wiped more thoroughly, thus making it easier to apply makeup, enabling the user to apply as much makeup as necessary locally from the less-wiped portion of the brush, and then to separate the eyelashes by using the bristles that carry less makeup.

Figure 37:
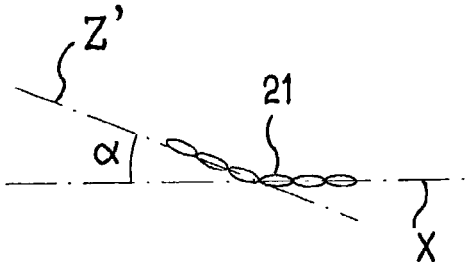
FIG. 37 shows a portion of the core to illustrate an angle formed between the direction of the core and the axis of the stem.

The direction Z' of the core is at an angle $\alpha$ relative to the axis X of the stem at all points along its length, which angle may vary, but is always less than 90°, as shown in FIG. 37.

The core need not be covered in bristles over the entire length of its portion extending beyond the stem 6.

Thus, as can be seen in FIG. 10, the core may have a curvilinear bristle-carrying portion 211*a* to which bristles are connected and which is separated from the stem by a rectilinear portion 211*c* that carries no bristles and that is implanted at least in part in the stem 6. The core thus does not present constant curvature. The curvilinear portion 211*a* may be of curvature that is constant or otherwise.

Figure 7:
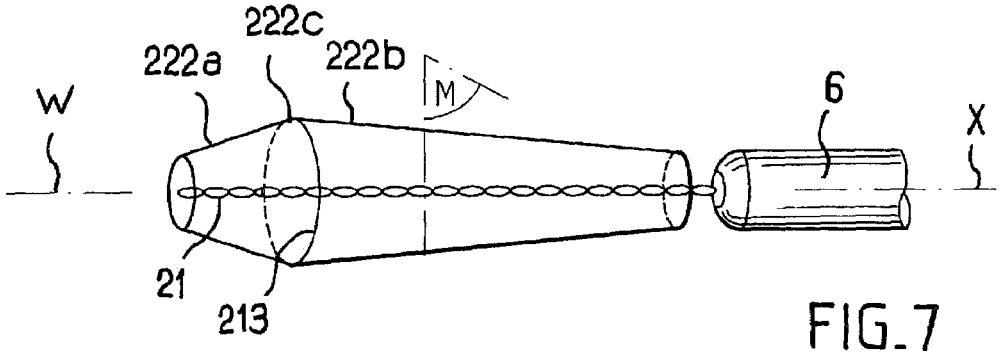
Figure 11:
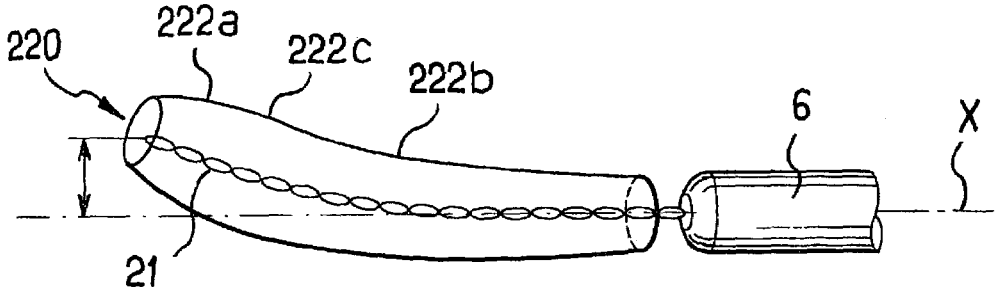

FIG. 11 shows a brush 220 which is obtained from the blank of FIG. 7 which is shaped like a buoy.

This blank is generally circularly symmetrical about the rectilinear axis W of the core 21, and has an envelope surface formed by uniting two truncated cones that touch base against base, thereby constituting a largest-diameter circle 213.

The top edge of the FIG. 7 blank is formed by combining the generator lines 222*a* and 222*b* of the truncated cones, and the region in the vicinity of the largest-diameter circle 213 constitutes a non-rectilinear edge 222*c*.

The envelope surface of the FIG. 7 blank is not symmetrical about a midplane M intersecting the core 21 halfway along the blank.

To make the brush 220 from the FIG. 7 blank, the core 21 is curved in such a manner as to bring the portions 222*a* and 222*b* substantially into alignment with each other, thereby also having the effect of increasing the curvature of the diametrically opposite bottom edge.

For example, the bristle-carrying portion of the core 21 is bent with a radius of curvature that is constant about an axis that is perpendicular to the plane of FIG. 7 and that is situated beside the top edge of the blank. Overall, the core 21 presents curvature that is not constant, while the portion thereof that is inserted into the stem is rectilinear.

In FIG. 11, it can be seen that the edge 222*c* has become substantially rectilinear.

Figure 8:
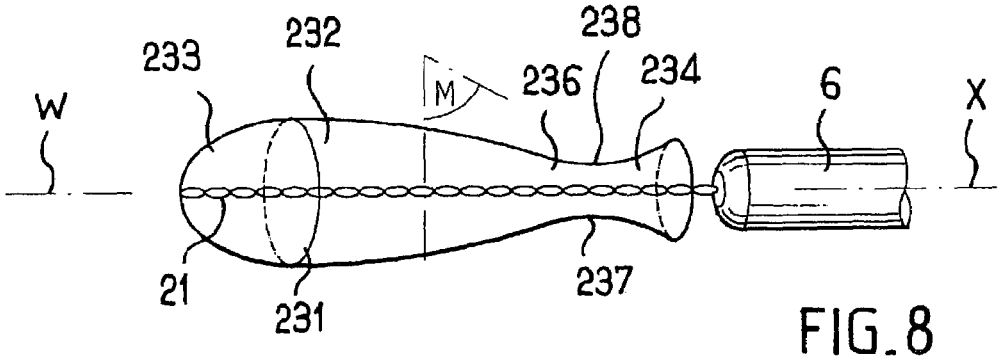
Figure 12:
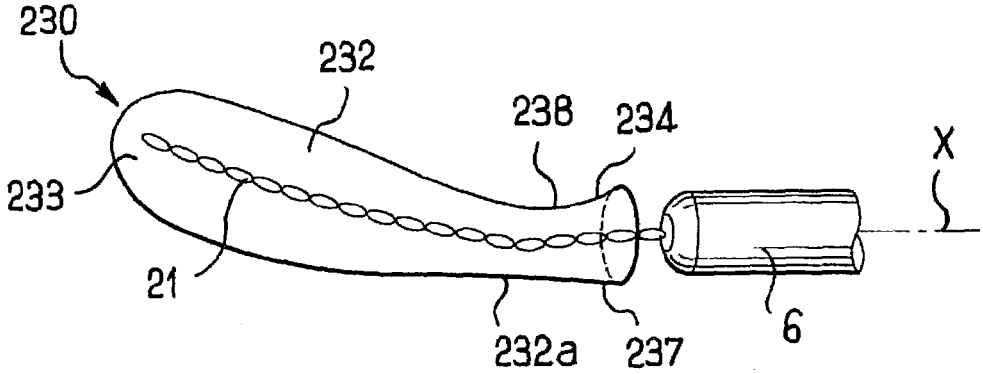

FIG. 12 shows a brush 230 made from the FIG. 8 blank which is fish-shaped.

The envelope surface of this blank is circularly symmetrical about the rectilinear axis W of the core 21, and not symmetrical about the midplane M that intersects the core 21 halfway along the bristle-carrying portion of the blank.

The blank of FIG. 8 comprises a body 232 whose diameter is at a maximum at a largest-diameter circle 231. The distal end portion 233 which extends in front of the largest-diameter circle 231 is bullet-shaped. The proximal end portion 234 of the blank is connected to the body 232 via a narrowed portion 236. The bottom edge 237 of the blank in this narrowed portion 236 forms a downwardly concave recess.

In order to make the brush 230, curvature is imparted to the core 21 of the FIG. 8 blank in such a manner as to flatten the bottom edge 237 and make it less recessed or even rectilinear as in the example shown.

The top edge 238 diametrically opposite the narrowed portion 236 becomes more curved because of the twisting imparted to the core 21.

FIG. 12 shows that the portion 232*a* of the bottom edge of the body 232 that is adjacent to the narrowed portion 236 is also straightened out because of the curvature imparted to the core.

Figure 9:
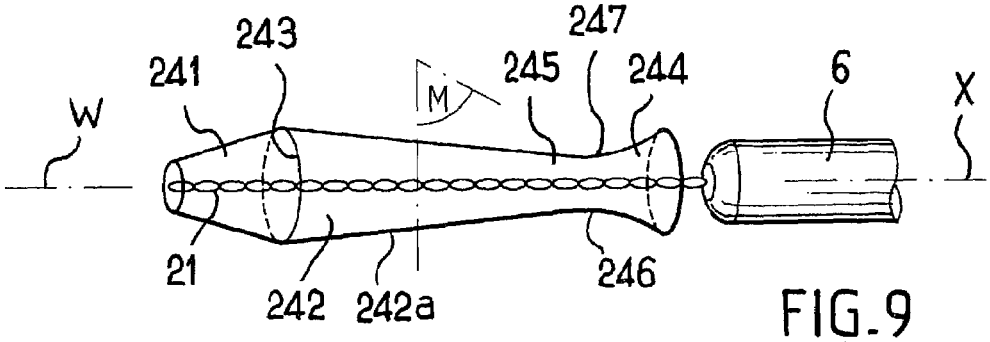
Figure 13:
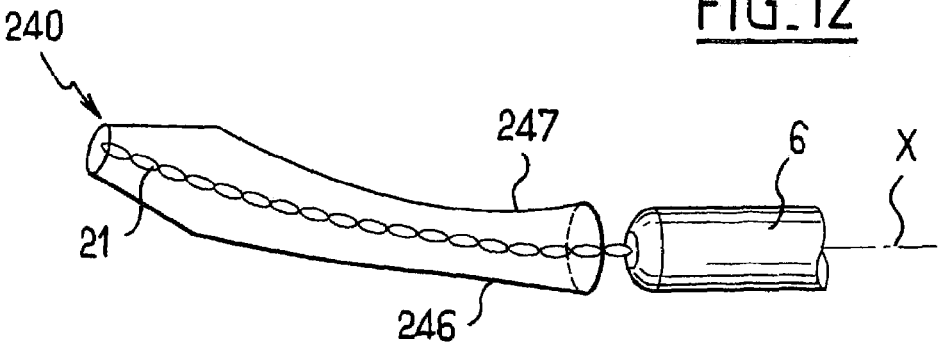

FIG. 13 shows a brush 240 obtained from the blank shown in FIG. 9. The envelope surface of this blank is generally fish-shaped, being circularly symmetrical about the rectilinear axis W of the core 21. The distal end portion 241 of the blank is in the form of a truncated cone. The body 242 of the blank in its region adjacent to the largest-diameter circle 243 is frustoconical in shape. The body 242 is connected to the proximal end 244 of the blank via a narrowed portion 245. The bottom edge 246 of the narrowed portion 245 is downwardly concave.

The FIG. 9 blank is converted into the brush 240 by imparting a certain amount of curvature to the core 21 in such a manner as to flatten out the bottom edge 246 so as to ensure that even if it is not rectilinear and in line with a generator line 242*a* of the body 242, it is at least substantially less recessed than it was initially.

The curvature given to the core 21 has the effect of making the top edge 247 of the narrowed portion 245 that is diametrically opposite the bottom edge 246 more recessed.

Each of the blanks shown in FIGS. 6 to 9 may have one or more facets or indentations made therein prior to curving the core.

Figure 14:
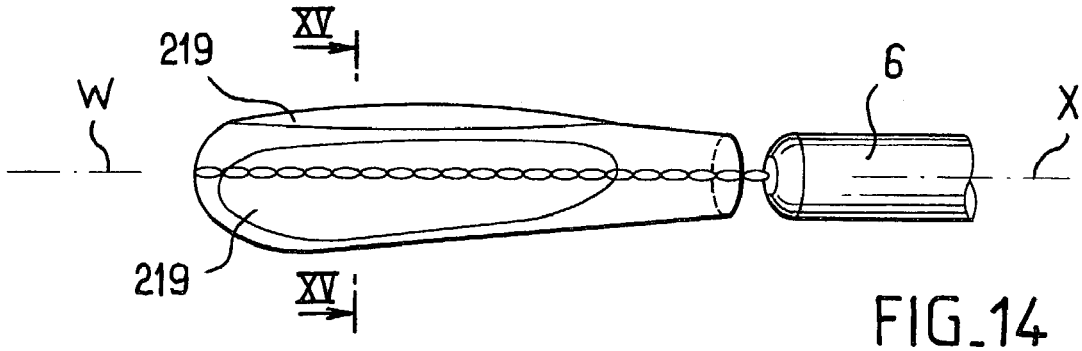
FIG. 14 shows the FIG. 6 blank with facets made therein.
Figure 15:
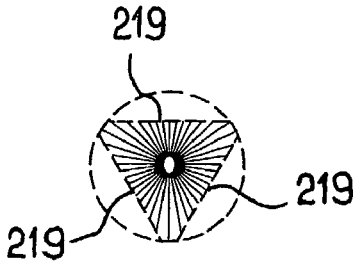
FIG. 15 is a cross-section on XV—XV of FIG. 14.

By way of example, FIG. 14 shows the FIG. 6 blank with at least there substantially plane facets 219 made therein so as to give the cross-section of the body of the blank a generally triangular shape as shown in FIG. 15.

In the example of FIG. 14, the facets 19 are substantially plane and parallel to the axis W of the core.

Figure 16:
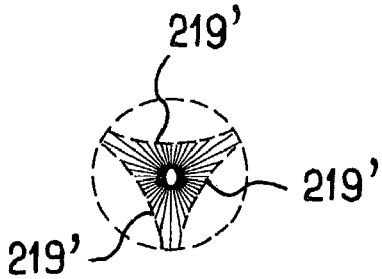
FIG. 16 is a cross-section similar to FIG. 15 showing a variant embodiment having indentations.

In a variant, they could be replaced by indentations 219' presenting a cross-section that is outwardly concave, as shown in FIG. 16, or by indentations presenting a profile that is outwardly concave when the brush is observed in a direction perpendicular to the axis of the stem, the profile of the indentation possibly constituting a circular arc, for example.

Figure 17:
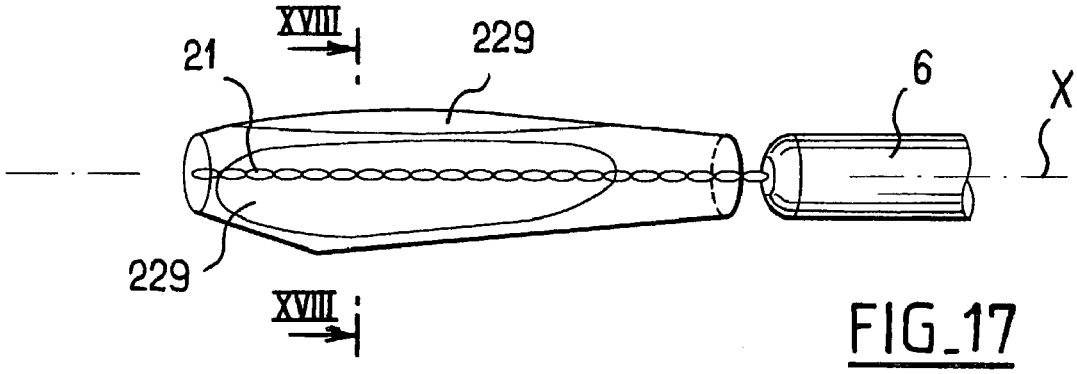
FIG. 17 shows the FIG. 7 blank with facets made therein.
Figure 18:
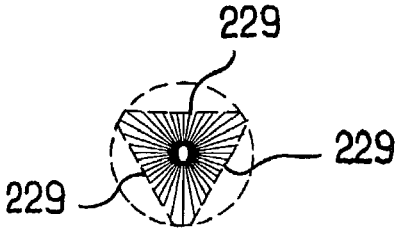
FIG. 18 is a cross-section on XVIII—XVIII of FIG. 17.

FIG. 17 shows the FIG. 7 blank with three substantially plane facets 229 made therein so as to give the body of the blank a cross-section that is generally triangular in shape, as shown in FIG. 18.

Figure 19:
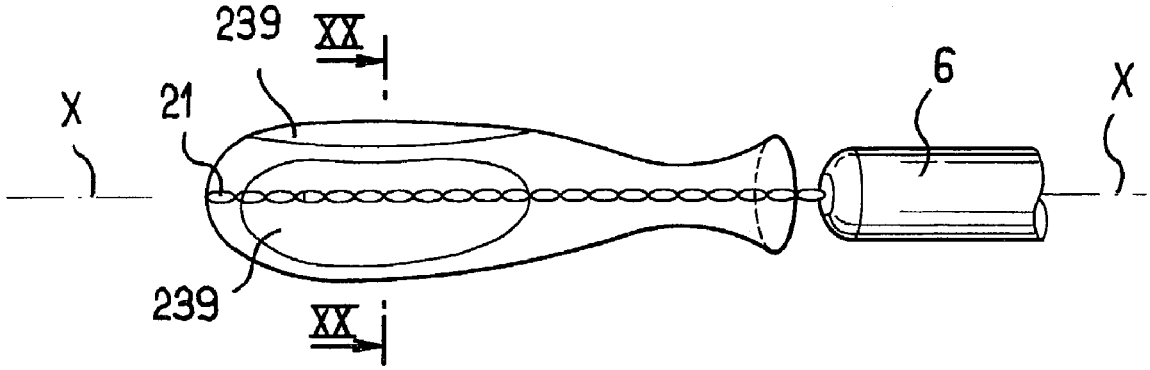
FIG. 19 shows the FIG. 8 blank with facets made therein.
Figure 20:
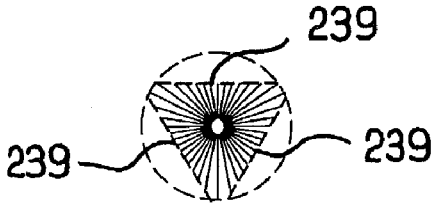
FIG. 20 is a cross-section on XX—XX of FIG. 19.

FIG. 19 shows the FIG. 8 blank with three substantially plane facets 239 made therein, giving the cross-section of the body of the blank a shape that is generally triangular, as can be seen in FIG. 20.

Figure 21:
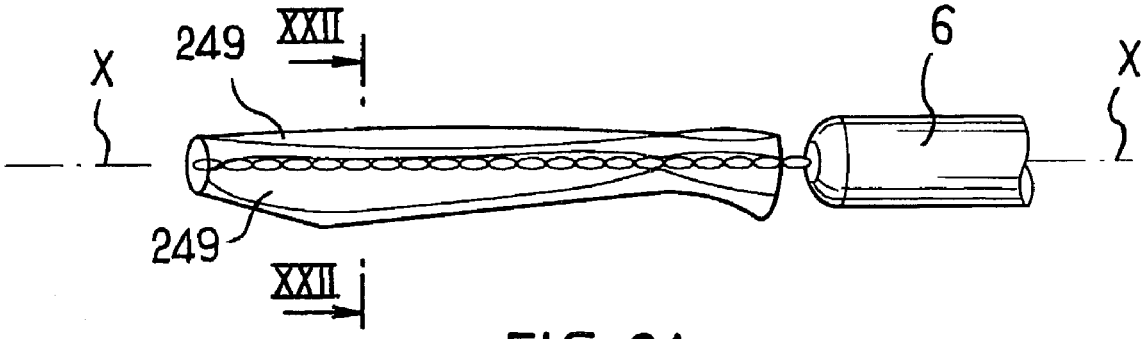
FIG. 21 shows the FIG. 9 blank with facets made therein.
Figure 22:
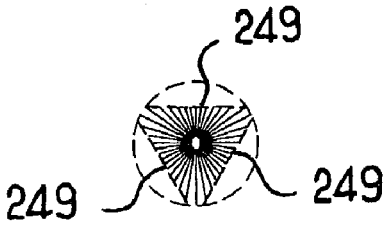
FIG. 22 is a cross-section on XXII—XXII of FIG. 21.
Figure 23:
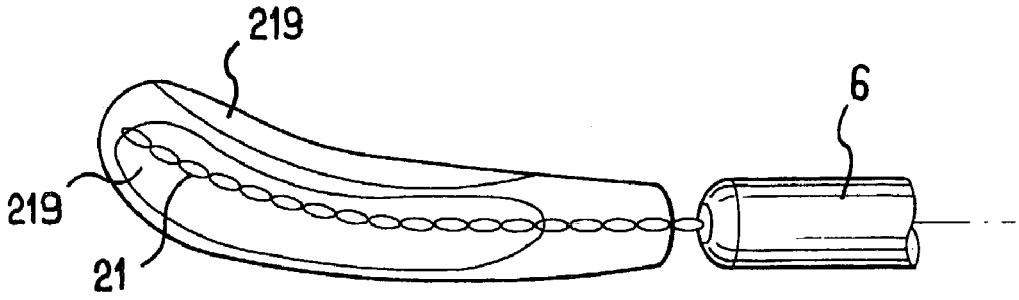
FIG. 23 shows the FIG. 14 blank after its core has been curved.
Figure 24:
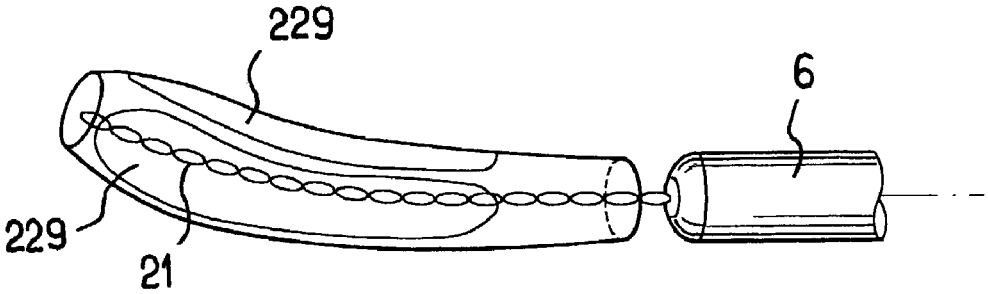
FIG. 24 shows the FIG. 17 blank after its core has been curved.
Figure 25:
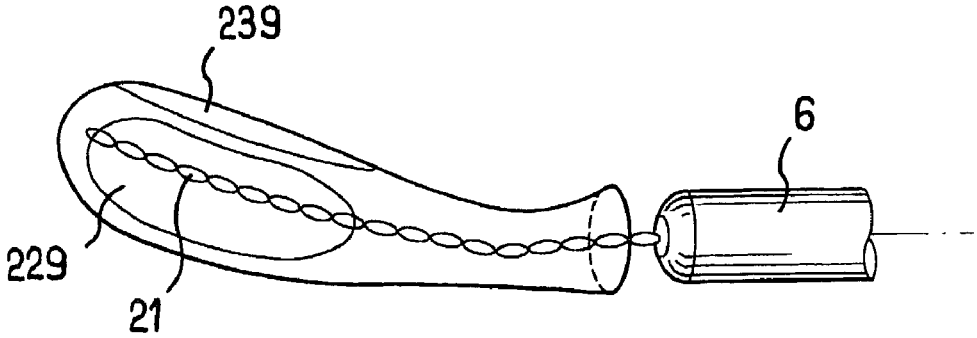
FIG. 25 shows the FIG. 19 blank after its core has been curved.
Figure 26:
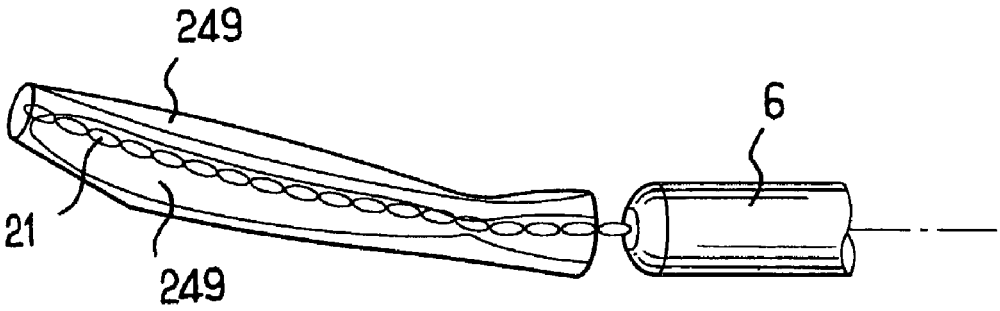
FIG. 26 shows the FIG. 21 blank after its core has been curved.

FIGS. 21 and 22 show the FIG. 9 blank with three substantially plane facets 249 made therein.

Whereas the facets 239 in the example of FIG. 19 extend only in the body of the brush, in the example of FIG. 21 the facets extend over the entire length of the blank, including over its proximal end portion.

FIGS. 23 to 26 show the brushes obtained after subjecting the blanks of FIGS. 14, 17, 19, and 21 respectively to the same transformations as convert the blanks of FIGS. 6 to 9 to the brushes of FIGS. 10 to 13.

In the examples of FIGS. 23 to 26, the plane of curvature of the core can be substantially perpendicular to the facets 219, 229, 239, or 249 which is situated dynamically opposite the non-rectilinear edge which becomes straightened. The plane of curvature of the core 21 may also be a midplane of symmetry for a facet.

In all of the examples described above, the core 21 is curved about a single axis only.

Without going beyond the ambit of the present invention, it is possible to curve the core about two or more axes which may optionally be parallel, optionally be perpendicular, and which may optionally intersect.

Figure 27:
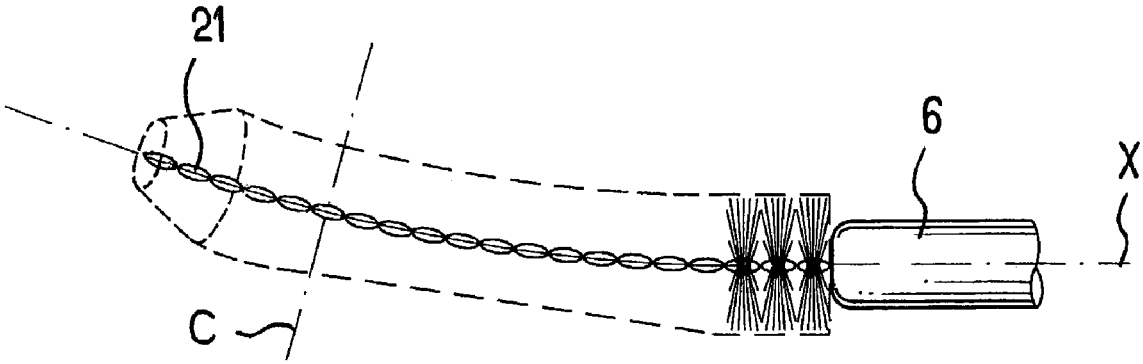
FIG. 27 shows the FIG. 13 brush after its core has been subjected to second twisting.

By way of example, FIG. 27 shows the FIG. 13 brush with the core being subjected to second twisting about a curving axis C parallel to the plane of FIG. 27, i.e. parallel to the plane of curvature of the FIG. 13 brush.

Because of this additional curving, the core 21 no longer occupies a single plane of curvature, and this can make the brush more ergonomic in use.

By way of example, it is possible for the brush to have at least one applicator surface that is substantially parallel to the stem.

It should be observed that it is particularly advantageous to start from a brush having a left-hand twist, as described below with reference to FIGS. 28 and 30.

Figure 28:
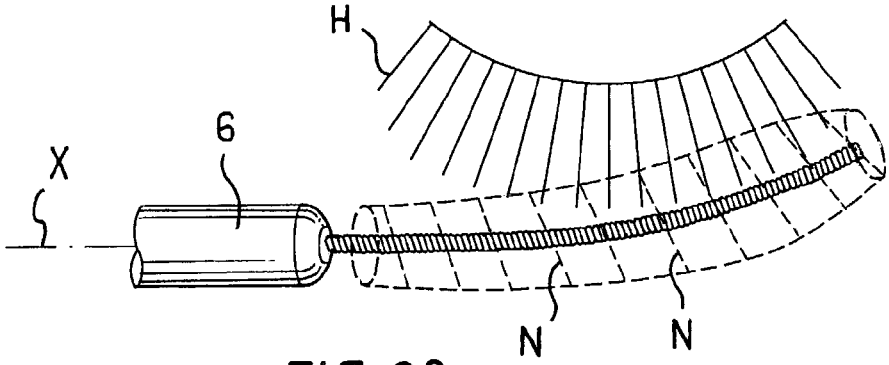
FIG. 28 is a diagram of the FIG. 10 brush with its core twisted to the left, while applying makeup to the eyelashes.

FIG. 28 shows the FIG. 11 brush with a core that is twisted with a left-hand twist.

Dashed lines show the paths followed by the sheets N defined by the ends of the bristles, these sheets being at an angle v relative to a plane perpendicular to the core.

Figure 29:
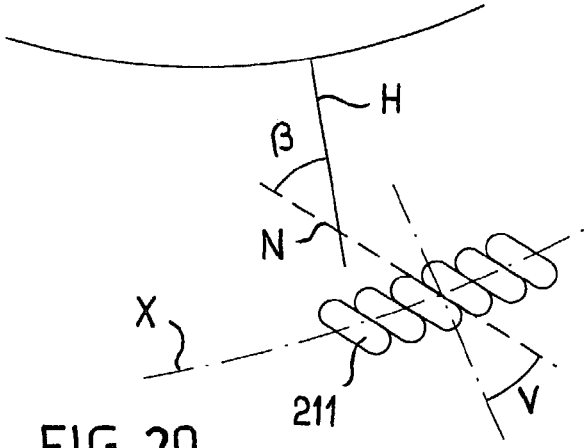
FIG. 29 shows various angles between a helical sheet, an eyelash, and the axis of the core.

On examining FIG. 29, it can be seen that the sheets N are at an angle relative to the axis X of the stem 6 that decreases on coming closer to the free end of the brush, thus making it possible to conserve a relatively large angle β between the eyelashes H at the end of the eyelid and the sheets N, thus enabling the eyelashes to be well separated.

Figure 30:
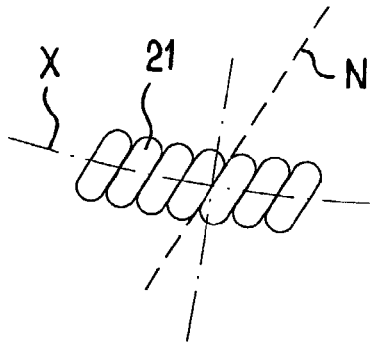
FIG. 30 is a view analogous to FIG. 28, showing a portion of the core in isolation, said core being twisted to the right.

Naturally, the invention is not limited to a core with a left-hand twist and it is also possible to use a core with a right-hand twist, as shown in part in FIG. 30.

Figure 31:
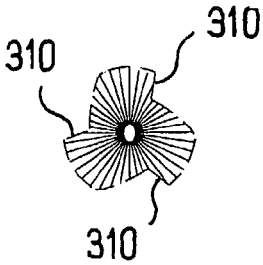
FIG. 31 shows a cross-section with serrations.

It is possible to make serrations on a brush of the invention, as shown in FIG. 31. In this figure, it can be seen that the brush has been machined in such a manner as to form setbacks 310 in its surface with blanks that are substantially radial, occupying at least a fraction of the length of the brush.

Figure 32:
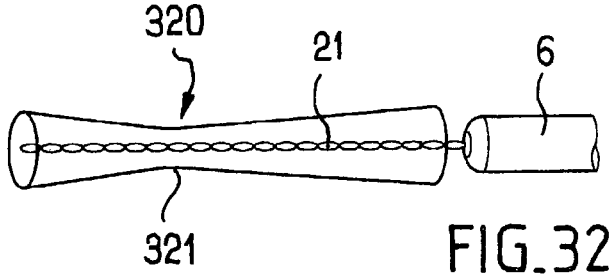
FIG. 32 is a diagram of a brush that is generally hourglass-shaped, prior to curving the core.

FIG. 32 shows a blank 320 of generally hourglass-shape, giving a non-rectilinear edge 321 in the smallest-diameter portion of the brush, when the brush is observed from the side, which edge is to be straightened out by imparting local curvature to the core.

Figure 33:
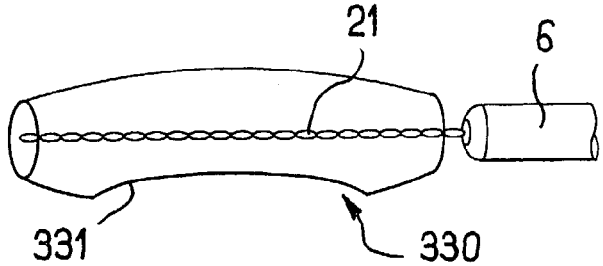
FIG. 33 is a diagram of a brush that is generally (rugby or American) football-shaped, including an indentation, prior to curving its core.

FIG. 33 shows a blank 330 that is generally in the form of a football for playing rugby football or American football, and including an indentation 331.

This concave indentation 331 can be made substantially plane by imparting curvature to the core.

Figure 34:
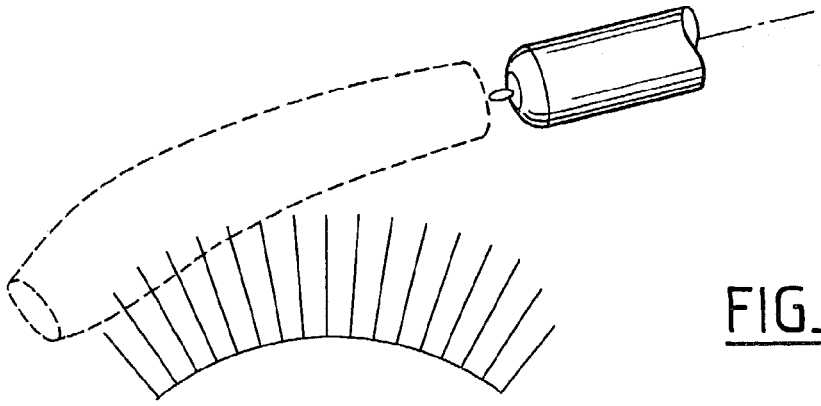
FIGS. 34 and 35 show the FIG. 11 brush in use for making up the eyelashes.
Figure 35:
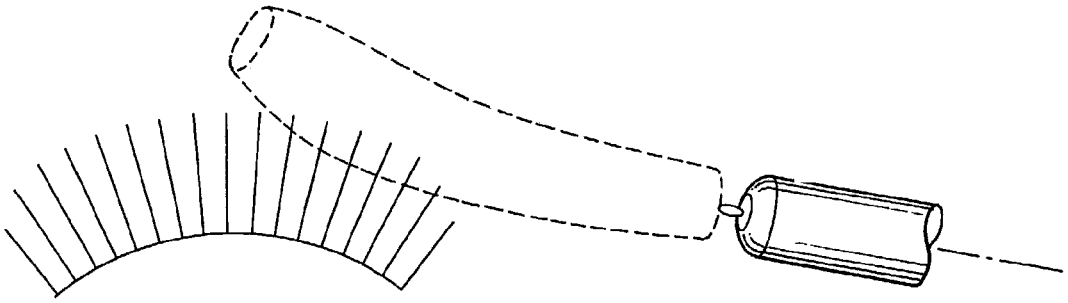

FIGS. 34 and 35 show the FIG. 11 brush in use for making up the eyelashes. One side of the brush can be used for making up the eyelashes situated at one end of the eyelid, while the opposite side of the brush can be used for making up the eyelashes situated at the opposite end of the eyelid.

Figure 36:
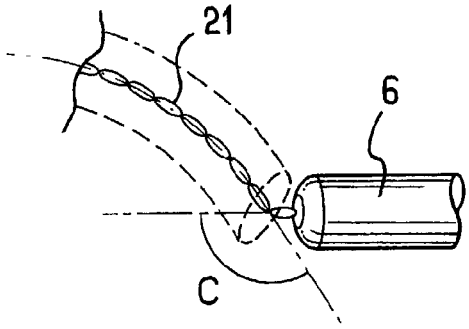
FIG. 36 shows a bend being made in the core close to the stem.

The core 21 of a brush as described above can be bent very close to the stem 6, as shown in FIG. 36, so as to change the way in which it handles, should that be necessary.

Figure 38:
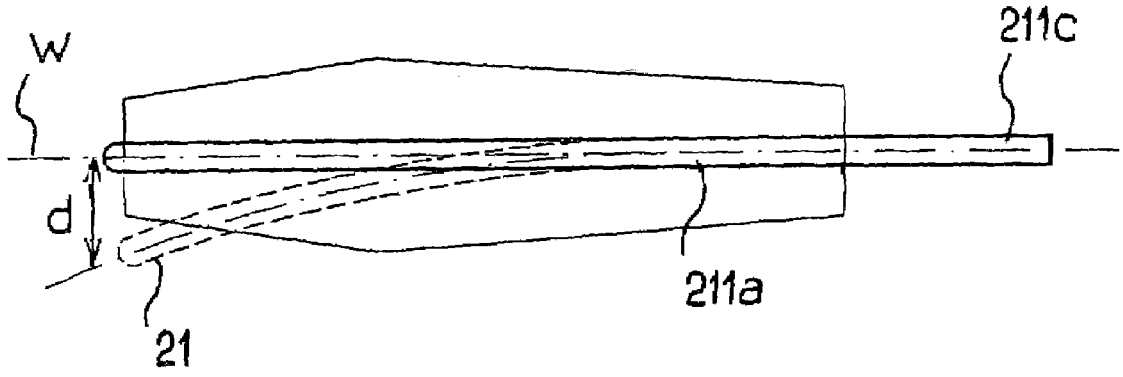
FIGS. 38 and 39 show two examples of blanks with the curvature given to the core being drawn in dashed lines.
Figure 39:
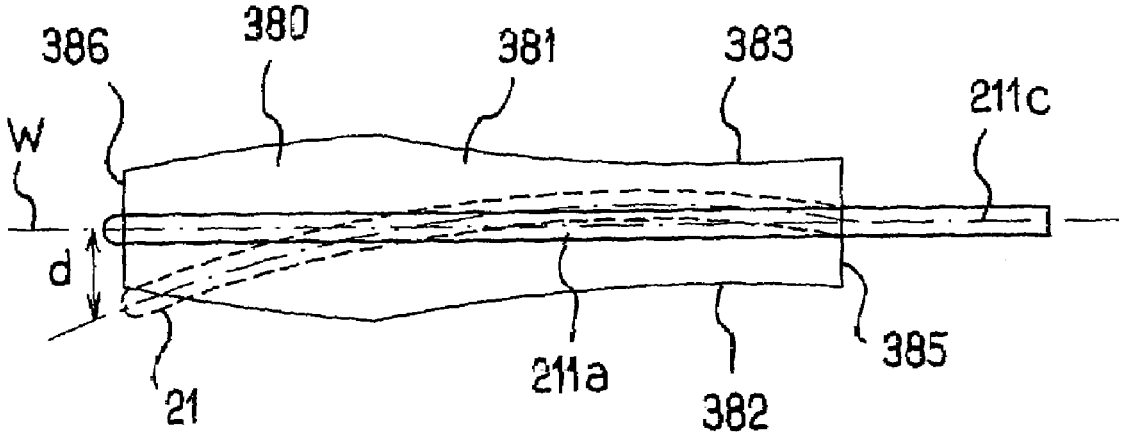

FIGS. 38 and 39 show two brush blanks prior to the core being curved and implanted in the stem. It can be seen that the core 21 in each of these examples is entirely rectilinear prior to being implanted in the stem. The shape of the core after it has been curved is drawn in dashed lines. In the example of FIG. 38, the blank presents an envelope surface in the form of two truncated cones about the axis W of the core 21. The total length of the portion 221*a* carrying the bristles is about 26 mm, for example. The largest diameter of the blank may be slightly greater than 7 mm, while its end diameters may be close to 4 mm. The total length of the core 21 may be slightly greater than 35 mm. The core 21 may be curved, while maintaining the portion 221*c* close to the stem rectilinear so as to give the portion 211*a* a radius of curvature that is close 60 mm. The free end of the core may be offset from the axis of the rectilinear portion 211*c* by a distance d which may be about 4.5 mm.

FIG. 39 shows another example of a blank which, prior to curving the core, is generally fish-shaped, having a front portion 380 that is substantially frustoconical and a body 381 that is circularly symmetrical, being defined in longitudinal section by two opposite circular edges 382 and 383 that are outwardly concave, with a radius of curvature of about 52 mm. The diameter of the brush at its rear end plane 385 may be about 7.5 mm, and its diameter at the front end plane 386 may be about 5 mm.

The blank shown in FIG. 39 is converted into the final brush by curving the portion 211*a* of the core that carries the bristles so as to have a radius of curvature in the example shown that is constant and equal to about 53 mm, the end of the portion 211*a* adjacent to the portion 211*c* possibly forming a small angle with the axis of the portion 211*c*, as shown. The distance d through which the free end of the core is offset may be about 2.4 mm.

In the figures, the curvature of the core has been exaggerated in order to make the description easier to understand. It would not go beyond the ambit of the present invention for the curvature to be less marked, for example to match the curvature of an eyelid.

The core may also be curved in an S-shape in a single plane of curvature.

It will be understood that the brushes as described above are capable of being subjected to non-uniform wiping, with a distal end portion that is offset relative to the axis of the stem. Brushes may present faces of different shapes serving to obtain multiple effects.

Figure 40:
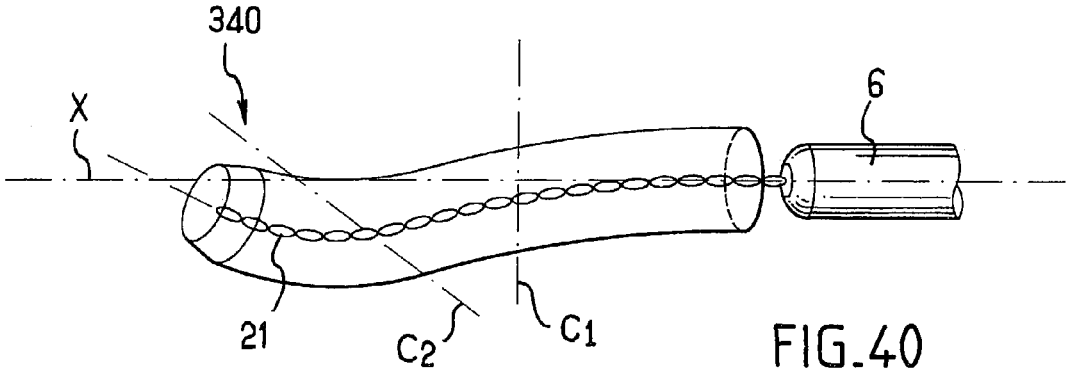
FIG. 40 is a diagram showing an example of a brush whose core has been curved about at least two axes.

FIG. 40 shows a brush 340 of arbitrary shape and having the special feature of being curved about two axes $C_1$ and $C_2$.

The $C_1$ and $C_2$ are not parallel, and in the example shown they are perpendicular.

Naturally, it would not go beyond the ambit of the present invention for the axis $C_2$ to intersect or not intersect the axis $C_1$ and for it to be perpendicular thereto or non-perpendicular relative thereto.

Such a brush presents the advantage of holding a supply of makeup in one portion of the brush and having another portion of the brush that is well wiped and good for combing and separating the eyelashes. It should also be observed that when the makeup is applied to the eyelashes by causing the brush to turn about the axis X of the stem 6, the bristles are caused to alternate transversely to the axis X in the off-center region of the brush corresponding to its distal end, and this can make it easier to cause the bristles to penetrate between the eyelashes and improve taking charge thereof.

Figure 41:
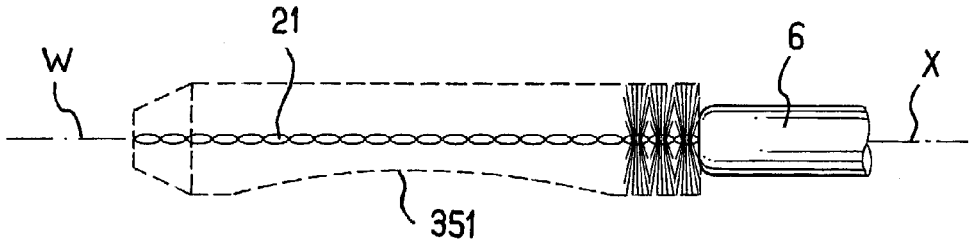
FIG. 41 shows a blank for making a brush in accordance with another aspect of the invention.
Figure 42:
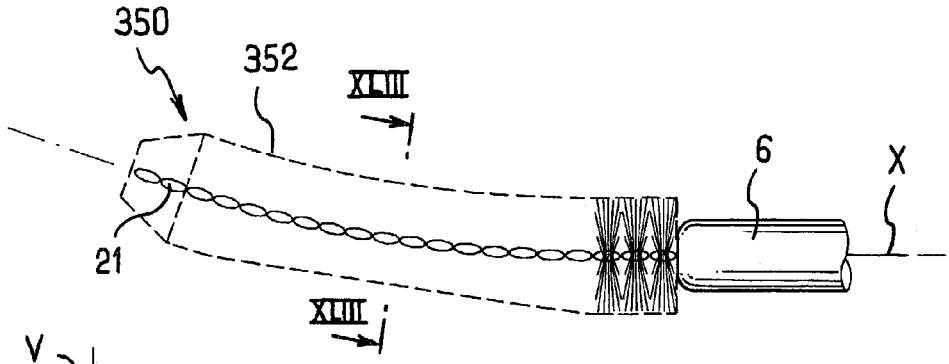
FIG. 42 shows the blank of FIG. 41, after its core has been curved.

FIG. 42 shows another example of a brush 350 made from the blank of FIG. 41. This blank is cylindrical, with a rectilinear core 21, and it extends along an axis W coinciding with the axis X of the stem 6. An indentation 351 is formed in the blank.

In order to make the brush 350 from the blank of FIG. 41, the core 21 is curved about a curving axis perpendicular to the plane of FIG. 41, said axis being situated on the side opposite from the indentation 351, thereby having the effect of flattening said indentation so as to transform it into a facet that is substantially plane. Forming such a facet to take the place of the indentation 351 causes an outwardly concave envelope surface 352 to be formed on the side opposite from the indentation 351.

Figure 43:
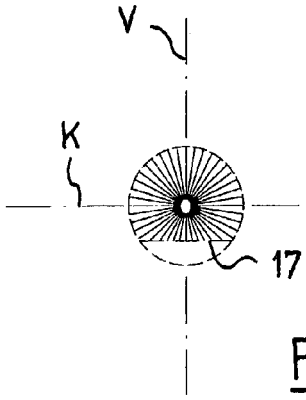
FIG. 43 is a diagrammatic cross-section on XLIII of FIG. 42.

On examining FIG. 43, it can be seen that the brush presents a cross-section in the portion of the core where the initial indentation 351 is made that is not symmetrical about a plane K perpendicular to the plane of curvature V of the core and containing its axis W.

It is also possible to start from a blank having a plurality of indentations.

Although numerous examples of brushes are given, the invention also applies to applicators provided with an applicator element configured to apply a cosmetic other than on keratinous fibers.

Figure 44:
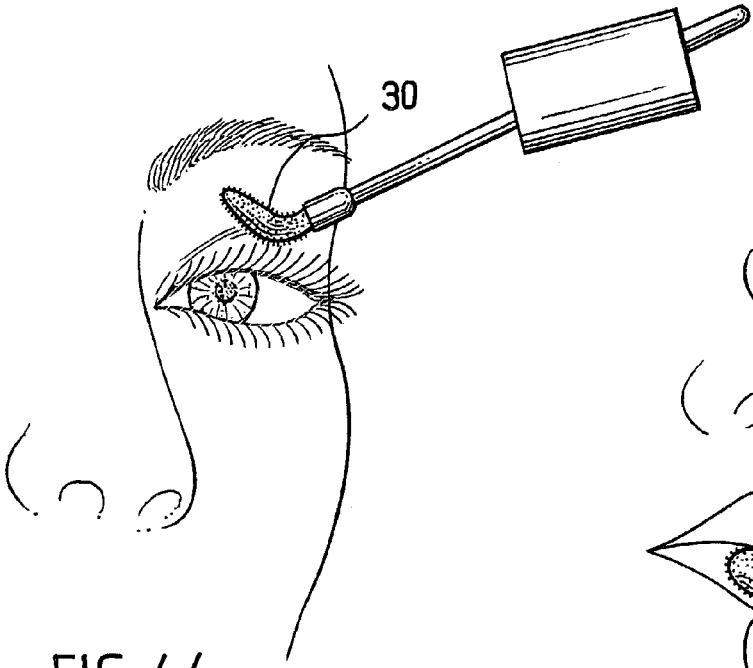
FIGS. 44 to 46 show various examples of other applicators.
Figure 45:
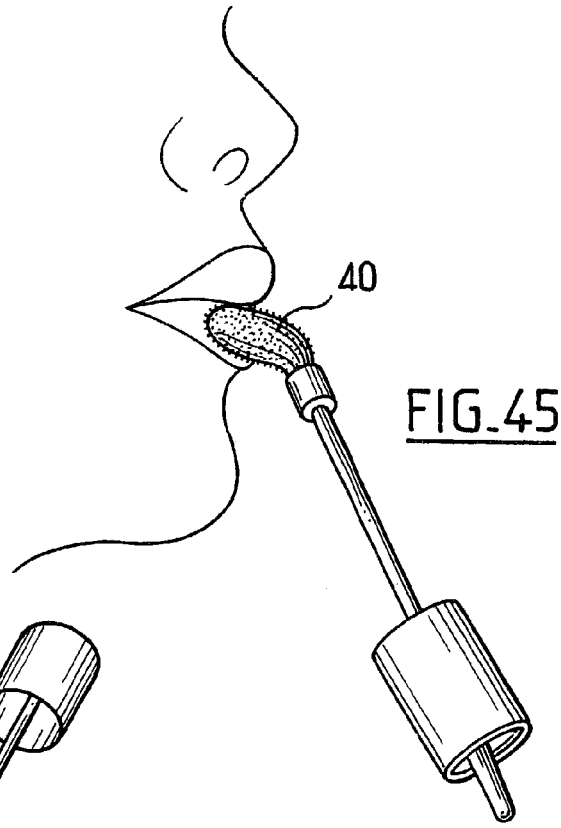
Figure 46:
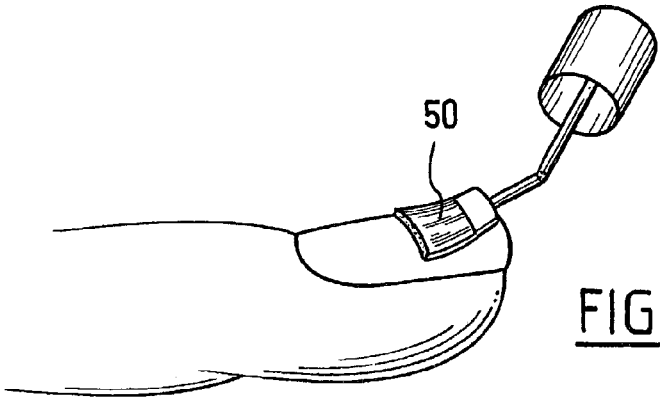

It is thus possible to use applicator elements having a flocked endpiece 30, e.g. for the purpose of making up an eyelid, as shown in FIG. 44, a flocked endpiece 40 for making up the lips, as shown in FIG. 45, or a paintbrush 50 for applying nail varnish, as shown in FIG. 46. It will be observed in this figure that the stem of the applicator is bent, such that the stem and the brush 50 are not entirely on a single straight line.

Figure 47:
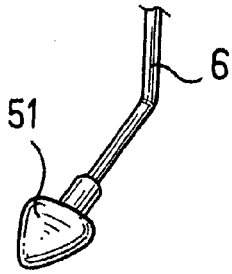
FIGS. 47 and 48 show how a curved stem can be used.

The applicator, only a portion of which is shown in FIG. 47, also has a bent stem. The axis of the applicator element 51 thus forms a non-zero angle with a portion of the stem. By way of example, the applicator element 51 may comprise a foam.

Figure 48:
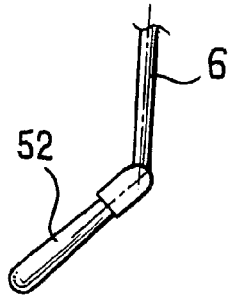

FIG. 48 shows the axis of the applicator element 52 at a non-zero angle relative to the applicator stem. By way of example, the applicator element 52 is constituted by a felt tip.

Figure 48A:
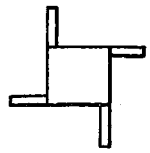
FIG. 48A is a cross-section view of an applicator element including serrations.

The applicator element may also include serrations, when observed in cross-section, as can be seen in FIG. 48A, and it can be made by injecting-molding a plastics material.

Figure 49:
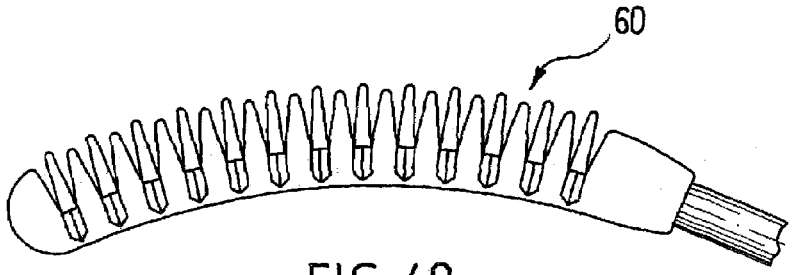
FIG. 49 shows, in isolation, a comb suitable for being present at the end of the stem of an applicator made in accordance with the invention.

It is also possible to use a comb 60 as shown in FIG. 49. Other non-limiting examples of combs are described in patent applications EP 1,169,941, EP 1,070,465, EP 1,070,468, and EP 1,070,467, in particular.

In the example of FIGS. 2 to 5, the maneuverable portion 18 of the stem 6 is made integrally with the remainder of the stem, e.g. by injection-molding a plastics material.

Figure 50:
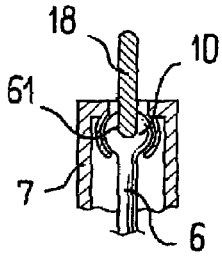

It would not go beyond the ambit of the present invention for the maneuverable portion 18 to be constituted by a piece fitted to the remainder of the stem 6, for example one end of the maneuverable portion being inserted in a socket 61 in the spherical portion 10, as shown in FIG. 50.

Figure 51:
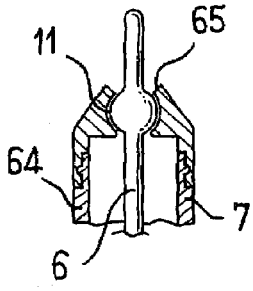
FIGS. 50 to 52 show various examples amongst others of how the hinge can be made.

The hinge connecting the stem 6 to the handle member 7 may be formed by means of a piece that is fitted to the remainder of the handle member 7, as shown in FIG. 51. This figure shows that the socket 11 is formed in a piece 63 which is fixed to the remainder 64 of the handle member by snap-fastening, for example.

FIG. 51 also shows that the opening of the handle member 7 through which the maneuverable portion 18 projects can be defined by edges 65 that diverge outwards.

Figure 52:
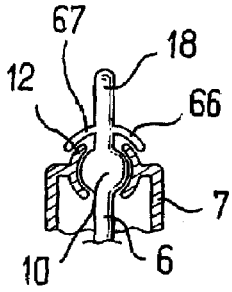

The wall 12 which defines the socket 11 of the ball joint may extend, for example, at least in part outside the handle member 7, as shown in FIG. 52.

The maneuverable portion 18 may be provided with a cover 66 for overlying the wall 12 of the socket 11 at least in part with small clearance, the cover 66 possibly presenting a concave face 67 facing towards the wall 12, as shown in the figure.

Figure 53:
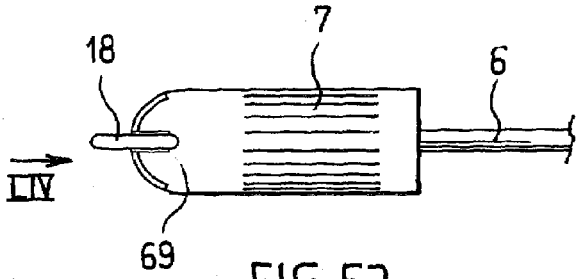
FIG. 53 is a fragmentary side view of an applicator constituting a variant embodiment of the invention.

The handle member 7 may include an end wall 69 at one axial end, as shown in FIG. 53, said wall being pierced by one or more slots through which the maneuverable portion 18 can pass.

Figure 54:
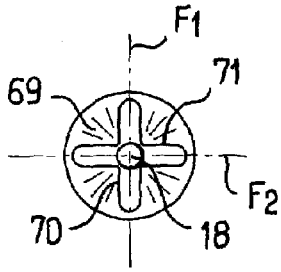
FIG. 54 is a front view looking along arrow LIV of FIG. 53.

In the example of FIG. 54, the end wall 69 is pierced by two slots 70 and 71 having respective mutually perpendicular axes $F_1$ and $F_2$ and of width that corresponds substantially to the diameter of the maneuverable portion 18, which portion can move in the slot when the stem 6 is inclined relative to the handle member 7.

The presence of the slots 70 and 71 serves to restrict the movements available to the stem 6 relative to the handle member 7 to the directions of the axes $F_1$ and $F_2$.

Figure 55:
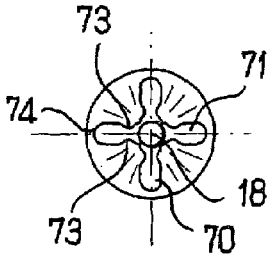
FIGS. 55 and 56 are views analogous to FIG. 54, showing variant embodiments.

In the example shown, the end wall 69 is generally outwardly convex in shape. As shown in FIG. 55, at least one of the above-mentioned slots, and for example both of the slots 70 and 71, may include at least one projection 73, e.g. two facing projections 73, thereby creating a hard point through which the maneuverable portion 18 can be pushed, thus serving to contribute to holding the maneuverable portion 18 in a predetermined position, e.g. in abutment against the axial end of one of the slots.

In the example of FIG. 55, the user can thus bring the maneuverable portion 18 into one of five predefined positions, namely central position in which the portion 18 is at the intersection of the slots 70 and 71, with the stem 6 being inclined at a substantially zero angle relative to the axis Y, and four extreme positions in each of which the maneuverable portion 18 comes into abutment against one of the axial ends of a slot. To go from the central position to any one of the end positions, it is necessary to go past a hard point associated with the presence of the projections 73.

Figure 56:
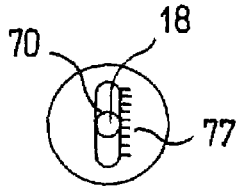

For example, if it is desired for the stem 6 to be capable of pivoting about a single geometrical axis only, then the handle member 7 need have only one slot 70, as shown in FIG. 56.

When the stem pivots in one plane only, the applicator element may present a curved longitudinal axis extending in said plane.

The handle member may include at least one reference mark 77 enabling the user to identify the position of the maneuverable portion 18 relative to the handle member. By way of example, the handle member may carry a plurality of graduations.

The maneuverable portion 18 may be covered by a sheath which may be made in various ways. By way of example, the sheath may contribute to making the receptacle leaktight.

Figure 57:
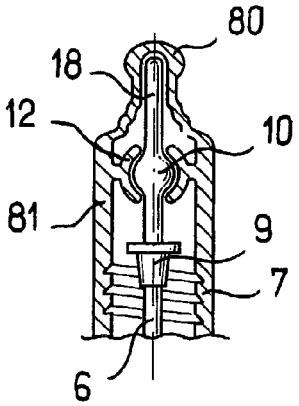
FIGS. 57 to 64 are fragmentary views of other examples of applicators.

FIG. 57 shows a sheath 80 made by overmolding an elastomer on a portion 81 of the body of the handle member 7.

Figure 58:
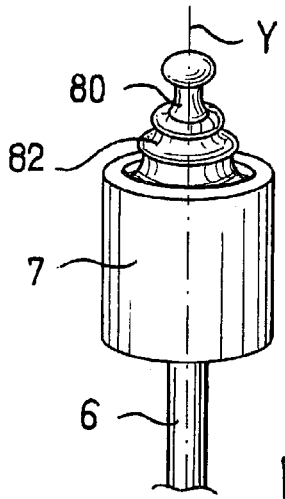

The sheath may be made with folds 82 as shown in FIG. 58, for example, the folds 82 acting like a bellows to confer flexibility in all directions on the sheath so as to enable the stem 6 to be maneuvered.

In the examples of FIGS. 57 and 58, the sheath may be generally circularly symmetrical in outside shape about the axis Y of the handle member 7, but it would not go beyond the ambit of the invention for the sheath to be not circularly symmetrically, perhaps for the purpose of defining one or more privileged directions for displacement of the maneuverable portion.

Figure 59:
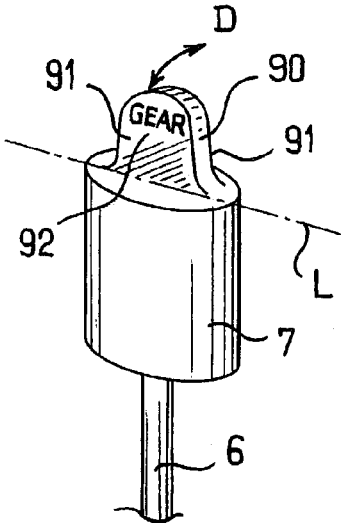

As an illustration, FIG. 59 shows a sheath 90 having two opposite surfaces 91 that are substantially plane, against which the user can press in order to change the angle of inclination of the stem 6 relative to the handle member 7.

One of these surfaces 91 may possibly include a message 92 inviting the user to press thereon.

As shown in FIG. 59, the sheath may be given a shape that serves to restrict angular displacement of the stem 6 to displacement about a single axis only.

In the example of FIG. 59, the flexibility of the sheath 90 in the direction D substantially perpendicular to the surfaces 91 encourages pivoting the stem about an axis L that is substantially parallel to the surfaces 91, whereas the greater stiffness of the sheath 90 in the direction of the axis L tends to prevent the stem from being pivoted about an axis perpendicular to the axis L.

The socket of the ball joint may be formed by a wall that is made integrally by injection-molding the same material as the sheath, for example in order to slow down movements of the stem by generating a high level of friction.

Figure 60:
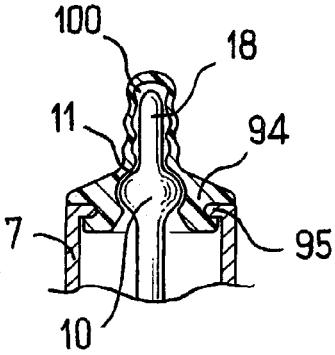

For example, FIG. 60 shows a sheath 100 comprising a base portion 94 snap-fastened on a rim 95 of the handle member. The base portion 94 defines the socket 11 in which the spherical portion 10 of the stem 6 is received.

The sheath engaged on the maneuverable portion 18 may optionally have no portion that is fixed relative to the handle member.

The maneuverable portion 18 may be free inside the sheath and enable relative displacement, in particular axial displacement, to take place between the maneuverable portion 18 and the sheath when the angle of inclination of the stem is modified.

The maneuverable portion 18 need not be free relative to the sheath, for example in order to generate stresses tending to return the stem into a rest position in which the axis X coincides substantially with the axis Y.

Where appropriate, the sheath may constitute a resilient return member for returning the stem into a position of zero inclination at rest.

The sheath may also comprise a block of cellular material fixed on the body of the handle member.

Figure 61:
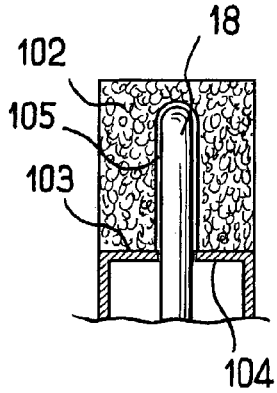

By way of example, FIG. 61 shows a sheath constituted by a block 102 of elastically deformable foam which is fixed via one face 103 by heat-sealing or by adhesive to an end wall 104 of the handle member.

The block 102 includes a recess 105 opening out into the face 103 and in which the maneuverable portion 18 is received.

Figure 62:
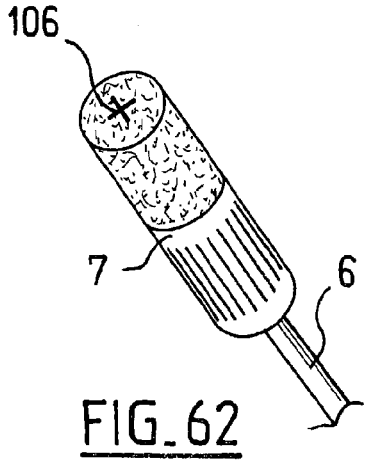

In a variant, the recess 105 may be replaced by one or more slots 106, for example two slots in a cross-configuration, as shown in FIG. 62.

Figure 63:
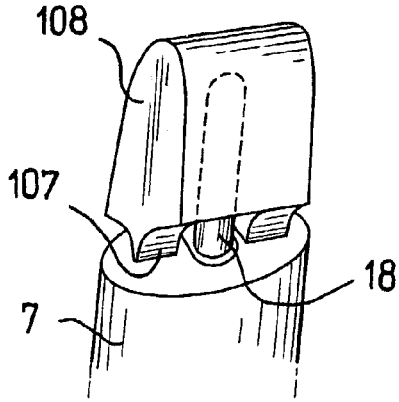

The sheath may also be made out of the same material as the handle member, for example being connected via a film hinge to the handle member, as shown in FIG. 63.

This figure shows a sheath 108 made integrally by injection-molding together with the handle member 7 and connected to the handle member via a film hinge 107.

The film hinge 107 is interrupted in a central region so as to allow the maneuverable portion 18 to pass therethrough.

Means other than a ball-and-socket joint can be used for providing a hinge between the stem and the handle member.

Figure 64:
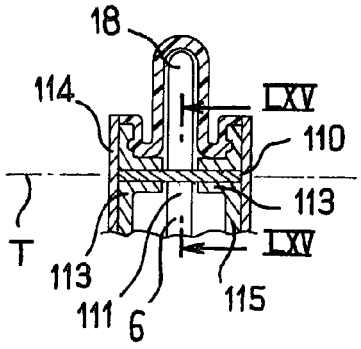
Figure 65:
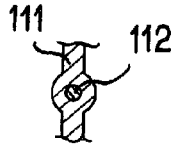
FIG. 65 is a section on LXV of FIG. 64.

By way of example, FIGS. 64 and 65 show a hinge comprising a pin 110 (e.g. a metal pin) extending along an axis T on which the stem 6 is engaged, the stem having an enlarged portion 111, for example, with plane faces that are substantially perpendicular to the axis T with an opening 112 passing therethrough for receiving the pin 110. The pin may be retained in diametrically opposite studs 113 of the handle member. The handle member may include an external covering 114, e.g. made of metal, fixed to its body 115 and also serving to prevent the pin 110 from escaping from the studs 113.

Figure 66:
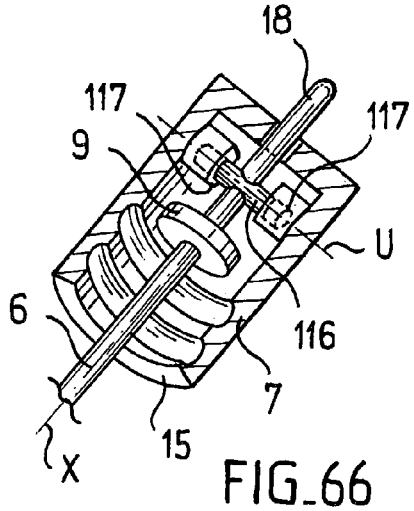
FIGS. 66 to 68 show other examples of hinges.

As shown in FIG. 66, it is also possible to make a hinge for the stem by replacing the spherical portion by a cylindrical portion 116, for example in order to allow the stem to pivot only about the axis U of said cylindrical portion which extends perpendicularly to the axis X of the stem. This cylindrical portion 116 may be received at its axial ends in sockets 117 that are open towards the end 15 of the handle member so as to enable the cylindrical portion 116 to be positioned in the sockets 117 by snap-fastening, at the same time as the maneuverable portion 18 is inserted into the corresponding opening of the handle member.

It is also possible to make the hinge by using a wall or a block of deformable material.

Figure 67:
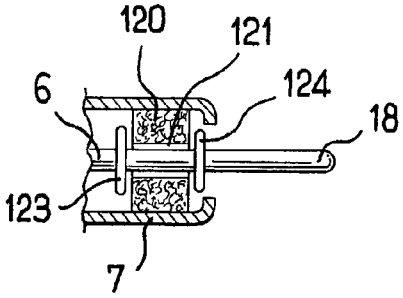

By way of example, FIG. 67 shows a hinge comprising a block 120 of cellular material, e.g. an elastically deformable foam which is fixed to the inside of the body of the handle member, e.g. by heat-sealing or by adhesive. The stem 6 passing through an opening 121 in the block 120, e.g. a slot, and it may include portions in relief 123 and 124 that are disposed on either side of the block 120, these portions in relief being large enough to hold the block 120 between them while the stem 6 is being manipulated by the user in order to change the direction in which it points.

Figure 68:
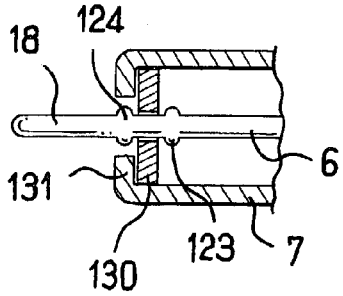

A simple disk 130, e.g. made of elastomer, could also be used as shown in FIG. 68, this disk being heat-sealed, for example, to a rim 131 of the handle member surrounding the opening through which the maneuverable portion 18 projects.

Figure 69:
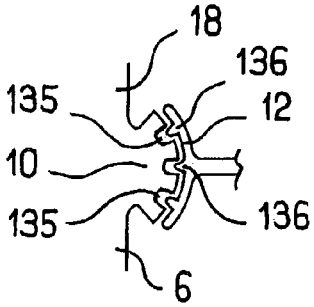
FIG. 69 shows a hinge with serrations.

The spherical portion 10 engaged in the socket 11 may have portions in relief 135, e.g. serrations as shown in FIG. 69 for co-operating with complementary portions in relief 136 formed on the wall 12 of the socket so as to brake the movement of the stem and/or so as to make it easier for it to be held in one or more predetermined angular positions. In a variant, the portions in relief 135 or 136 may be replaced by at least one cord of elastomer material for generating additional friction between the stem and the handle member.

Naturally, the invention is not limited to the embodiments described above. The characteristics of the various embodiments can be combined with one another, for example, in order to provide other embodiments in accordance with the invention.

Throughout the description, the term "comprising a" should be understood as being synonymous with "comprising at least one", unless the contrary is specified.

An applicator made in accordance with the invention need not be used in association with a receptacle into which the applicator is inserted when not in use. The applicator element may be loaded with the makeup for application, for example by being brought into contact with a cake of the makeup.

What is claimed is:

1. An applicator comprising:

a handle member;

only one stem connected to the handle member via a hinge; and a single applicator element at a first end of the stem, wherein the stem and the applicator element do not extend entirely along a common rectilinear axis, and wherein the stem includes a maneuverable portion enabling the direction in which the stem points relative to the handle member to be modified, said maneuverable portion extending at least in part between the hinge and a second end of the stem, opposite from the first end.

2. An applicator according to claim 1, wherein the applicator element has a longitudinal axis that is not rectilinear.

3. An applicator according to claim 1, wherein the stem has a longitudinal axis that is not rectilinear.

4. An applicator according to claim 1, wherein the stem has a longitudinal axis that is rectilinear.

5. An applicator according to claim 1, wherein the applicator element carries bristles or teeth extending transversely to a longitudinal axis of the applicator element.

6. An applicator according to claim 1, wherein the applicator element is configured to apply a makeup to keratinous fibers chosen among: the eyelashes, the eyebrows, the hair.

7. An applicator according to claim 1, wherein:

the applicator element is configured to apply a makeup to keratinous fibers chosen among eyelashes, eyebrows, and hair, the applicator element comprising a mascara brush, wherein the stem and the applicator element do not extend entirely along a common rectilinear axis, the portion of the stem adjacent to the brush has an axis, the brush having a core with a portion having bristles projecting therefrom, the bristles defining an envelope surface, wherein:

the core is curved over at least a fraction of its length; and the envelope surface is not symmetrical relative to a midplane of the portion from which the bristles project, said plane being perpendicular to the core.

8. An applicator comprising:

a handle member;

a stem connected to the handle member via a hinge; and an applicator element at a first end of the stem, the applicator element being configured to apply a makeup to keratinous fibers chosen among eyelashes, eyebrows, and hair, the applicator element comprising a mascara brush, wherein the stem and the applicator element do not extend entirely along a common rectilinear axis, the portion of the stem adjacent to the brush has an axis, the brush having a core with a portion having bristles projecting therefrom, the bristles defining an envelope surface, wherein:

the core is curved over at least a fraction of its length; and the envelope surface is not symmetrical relative to a midplane of the portion from which the bristles project, said plane being perpendicular to the core; and wherein the brush has a free end that is not in alignment with the axis of the portion of the stem adjacent to the brush.

9. An applicator according to claim 8, wherein the brush presents at least two side faces that are substantially planar.

10. An applicator according to claim 7, the brush having a cross-section as defined by the bristles of the brush, wherein the cross-section of the brush varies in non-monotonic manner from one end of the brush to the other.

11. An applicator according to claim 7, wherein the brush is made from a blank having a rectilinear core, the blank not being symmetrical about a midplane perpendicular to the core, having an edge that is not rectilinear when observed in profile in a direction perpendicular to the core, said edge being straightened out at least in part by imparting curvature to the core during fabrication of the brush.

12. An applicator according to claim 7, wherein the brush is made from a blank that is circularly symmetrical.

13. An applicator according to claim 7, wherein the brush is made from a blank presenting axial symmetry relative to an axis of the core.

14. An applicator comprising:

a handle member;

a stem connected to the handle member via a hinge; and an applicator element at a first end of the stem, the applicator element being configured to apply a makeup to keratinous fibers chosen among eyelashes, eyebrows, and hair, the applicator element comprising a mascara brush, wherein the stem and the applicator element do not extend entirely along a common rectilinear axis, and wherein the brush is curved about at least two axes that are not mutually parallel.

15. An applicator according to claim 7, wherein the brush is made from a blank in which at least one or more of an indentation and a facet have been formed.

16. An applicator according to claim 7, wherein the applicator element is configured to apply a makeup to keratinous fibers chosen among eyelashes, eyebrows, and hair, the applicator element comprising a mascara brush, wherein the brush has a core that is curved with bristles connected thereto, and wherein the brush presents a cross-section which varies over at least a fraction of the length of the brush in a manner that is not homothetic, said section at at least one point along the core not being symmetrical relative to a plane perpendicular to the plane of curvature of the core at said point.

17. An applicator according to claim 16, wherein the brush presents at least three side faces of shapes that are different from one another.

18. An applicator according to claim 1, wherein the applicator element comprises a brush made from a blank that presents a general shape chosen among: a bullet, a peanut, a buoy, a fish, an hourglass, or an American football.

19. An applicator according to claim 1, wherein the applicator element comprises a brush made from a blank presenting a cross-section that passes through at least one extremum between the two axial ends of the brush.

20. An applicator according to claim 1, wherein the applicator element comprises a comb configured to apply a makeup to at least one of the eyelashes and the eyebrows.

21. An applicator according to claim 1, wherein the applicator element comprises a flocked endpiece.

22. An applicator according to claim 1, wherein the applicator element is in the form of a paintbrush.

23. An applicator according to claim 22, wherein the paintbrush is a brush for applying nail varnish.

24. An applicator according to claim 1, wherein the hinge is disposed inside the handle member.

25. An applicator according to claim 1, wherein the hinge is configured to prevent one of a significant axial and a significant lateral displacement of the stem relative to the handle member at the hinge.

26. An applicator according to claim 1, wherein the handle member is configured to close a receptacle.

27. An applicator according to claim 1, wherein the handle member comprises a body having an end wall at one end which is provided with an opening through which the maneuverable portion passes.

28. An applicator according to claim 27, wherein the opening includes at least one slot.

29. An applicator according to claim 28, wherein at least one slot includes at least one edge defining a hard point during displacement of the maneuverable portion.

30. An applicator according to claim 1, wherein the maneuverable portion includes a cover configured to cover the handle member, at least in part.

31. An applicator according to claim 1, wherein the maneuverable portion is covered at least in part by a sheath including at least one flexible region.

32. An applicator according to claim 1, the applicator being configured in such a manner that the stem continues to point in a direction imparted thereto by the user, after the user has released the maneuverable portion.

33. An applicator,according to claim 1, wherein the hinge comprises a ball-and-socket joint.

34. An applicator according to claim 33, wherein the seat of the joint is rigid.

35. An applicator according to claim 1, wherein the stem includes a sealing member configured to co-operate in substantially in leaktight manner with a surface of a receptacle on which the applicator is fitted when not in use.

36. A device for packaging and applying a cosmetic, the device comprising a receptacle containing the cosmetic and an applicator as defined in claim 1.

37. A device according to claim 36, wherein the applicator is configured to close the receptacle.

38. A device according to claim 36, wherein the receptacle includes a wiper.

39. A device according to claim 36, wherein the receptacle and the applicator are configured in such a manner that the stem of the applicator is prevented from tilting relative to the receptacle when the applicator is in place thereon.

* * * * *